US012503846B2

(12) United States Patent
Middlebrook et al.

(10) Patent No.: US 12,503,846 B2
(45) Date of Patent: Dec. 23, 2025

(54) MODULAR SHELTER

(71) Applicant: Dignity Designed & Delivered Inc, Cleveland, OH (US)

(72) Inventors: Peter James Middlebrook, Dubai (AE); Mark E. Cipolla, Chardon, OH (US); Benjamin Philip Parker, Chardon, OH (US); David Pehar, Willoughby, OH (US); Joachim Gfoeller, Fremont, OH (US); Trevor L. Jackson, Kirtland, OH (US); John Wilford Spirk, Sr., Gates Mills, OH (US)

(73) Assignee: DIGNITY DESIGNED & DELIVERED INC., Cleveland, OH (US)

( * ) Notice: Subject to any disclaimer, the term of this patent is extended or adjusted under 35 U.S.C. 154(b) by 267 days.

(21) Appl. No.: 18/031,212

(22) PCT Filed: Oct. 8, 2021

(86) PCT No.: PCT/US2021/054130

§ 371 (c)(1),
(2) Date: Apr. 11, 2023

(87) PCT Pub. No.: WO2022/081427

PCT Pub. Date: Apr. 21, 2022

(65) Prior Publication Data

US 2023/0374769 A1 Nov. 23, 2023

Related U.S. Application Data

(60) Provisional application No. 63/090,313, filed on Oct. 12, 2020.

(51) Int. Cl.
*E04B 1/34* (2006.01)
*E04B 1/343* (2006.01)
(Continued)

(52) U.S. Cl.
CPC .. *E04B 1/34315* (2013.01); *E04B 2001/0092* (2013.01)

(58) Field of Classification Search
CPC ..... E04B 2001/0092; E04B 2001/0053; E04B 2001/0084; E04B 2001/2415;
(Continued)

(56) References Cited

U.S. PATENT DOCUMENTS 3,330,084 A * 7/1967 Russell ..... E04B 7/04 52/475.1
3,372,518 A * 3/1968 Rensch ..... E01C 5/10 52/283
(Continued)

FOREIGN PATENT DOCUMENTS

DE 102009028032 2/2011
SK 50082015 U1 * 9/2017 ..... E04B 1/26
(Continued)

OTHER PUBLICATIONS

International Search Report filed in PCT/US2021/054130 dated Feb. 28, 2022.

*Primary Examiner* — Ryan D Kwiecinski
(74) *Attorney, Agent, or Firm* — Rankin, Hill & Clark LLP

(57) ABSTRACT

A modular structure has a frame including header beams defining an outer perimeter of the structure at a top of the frame, header corner brackets connecting consecutively arranged header beams, footer beams defining an outer perimeter of the structure at a bottom of the structure, footer corner brackets connecting consecutively arranged footer beams, and intermediate beams extended between the top of the frame and the bottom of the structure, each intermediate beam being fixed with one of the header corner brackets, and fixed with one of the footer corners brackets. A roof supported on the frame includes an arm positioned on one of the
(Continued)

header corner brackets. A turnbuckle fixed at a position closer to the top of the frame as compared to the bottom of the structure, and fixed at a position closer to the bottom of the structure as compared to the top of the frame.

19 Claims, 20 Drawing Sheets

(51) Int. Cl.
*E04H 1/00* (2006.01)
*E04H 1/02* (2006.01)
*E04H 1/12* (2006.01)
*E04B 1/00* (2006.01)

(58) Field of Classification Search
CPC . E04B 2001/34876; E04B 2001/34884; E04B 1/34315; E04B 1/3483; E04B 1/34861; E04H 1/005; E04H 1/02; E04H 1/1205
USPC ..... 52/79.1, 79.14, 79.7, 749.13, 223.8, 52/223.14; 403/43
See application file for complete search history.

(56) References Cited

U.S. PATENT DOCUMENTS 3,382,625 A * 5/1968 Kuss ..... B65D 88/121 220/651
4,186,533 A * 2/1980 Jensen ..... E04B 2/7425 D25/1
4,295,307 A * 10/1981 Jensen ..... E04B 2/7425 D25/4
4,505,402 A * 3/1985 Gerhard ..... B65D 81/056 217/65
4,726,153 A * 2/1988 Adler ..... E04H 15/34 135/88.13
4,963,055 A 10/1990 Sims, Jr.
5,031,371 A * 7/1991 Davister ..... E04B 1/1909 52/236.1
5,274,981 A * 1/1994 Commins ..... E04H 1/1205 52/712
5,528,875 A * 6/1996 Ziegler, Jr. ..... A63B 9/00 403/231
6,076,328 A * 6/2000 Danhof ..... F16B 5/0685 52/762
6,161,339 A * 12/2000 Cornett, Sr. ..... E04H 9/14 52/223.13
8,176,703 B2 * 5/2012 Tremacchi ..... E04H 1/1238 403/171
8,429,858 B1 4/2013 Robinson
2004/0211147 A1 * 10/2004 Vanagan ..... E04G 11/48 52/79.1
2004/0255540 A1 12/2004 Wang
2005/0084324 A1 * 4/2005 Dubensky ..... E04B 1/3483 403/305
2005/0144857 A1 * 7/2005 Guerrero ..... E04B 1/34315 52/79.1
2007/0204575 A1 9/2007 Lisbona
2008/0134589 A1 * 6/2008 Abrams ..... E04B 1/34807 52/79.1
2011/0185646 A1 * 8/2011 Kovel ..... E04B 1/24 52/79.9
2013/0232886 A1 * 9/2013 Yoder ..... E04B 1/34315 52/653.1
2015/0135605 A1 5/2015 Price
2016/0153202 A1 6/2016 Matchung
2020/0149264 A1 5/2020 Pirrung

FOREIGN PATENT DOCUMENTS

WO WO-2012137137 A1 * 10/2012 ..... E04H 1/1205
WO WO-2015164975 A1 * 11/2015 ..... F16B 7/185
WO WO-2016178637 A1 * 11/2016 ..... E04B 1/26

* cited by examiner

MODULAR SHELTER

BACKGROUND

Conventional shelters are often prefabricated for potential deployment in a wide range of locations, under a variety of scale and circumstance. As such, there is a continued design objective in shelters for a modular shelter that can be efficiently manufactured, transported, and assembled on-site with a variety of potential configurations.

SUMMARY

In view of the foregoing, a modular structure has a frame including header beams defining an outer perimeter of the structure at a top of the frame, header corner brackets connecting consecutively arranged header beams, footer beams defining an outer perimeter of the structure at a bottom of the structure, footer corner brackets connecting consecutively arranged footer beams, and intermediate beams extended between the top of the frame and the bottom of the structure. Each intermediate beam is fixed with one of the header corner brackets, and fixed with one of the footer corners brackets. The structure also includes a roof supported on the frame, the roof including an arm positioned on one of the header corner brackets. The structure also includes a turnbuckle fixed with at least one of the header corner brackets, one of the header beams, one of the arm distal end portions, or one of the intermediate beams at a position closer to the top of the frame as compared to the bottom of the structure, and fixed with at least one of the footer corner brackets, one of the footer beams, or one of the intermediate beams at a position closer to the bottom of the structure as compared to the top of the frame, the turnbuckle being configured to exert tension along the intermediate beams between the top of the frame and the bottom of the structure.

According to another aspect, a frame for a modular structure includes perimeter beams defining an outer perimeter of the structure, corner brackets connecting consecutively arranged perimeter beams, and intermediate beams extended between a top of the frame and a bottom of the structure, each intermediate beam being fixed with at least one of the corner brackets.

According to another aspect, a modular structure has a frame including footer beams defining an outer perimeter at a bottom of the structure, and a floor formed from a plurality of floor tiles arranged in a tessellation that defines an outer perimeter having a shape similar to the outer perimeter of the structure defined by the footer beams. Each floor tile in the plurality of floor tiles is shaped as an equilateral triangle with a first side having a first side outward protuberance, a second side defining a second side recess having a shape that matches the first side outward protuberance for receiving the first side outward protuberance of another floor tile in the plurality of floor tiles, and a third side having a third side outward protuberance and defining a third side recess having a shape that matches the third side outward protuberance for receiving the third side outward protuberance of another floor tile in the plurality of floor tiles.

DETAILED DESCRIPTION

Figure 1:
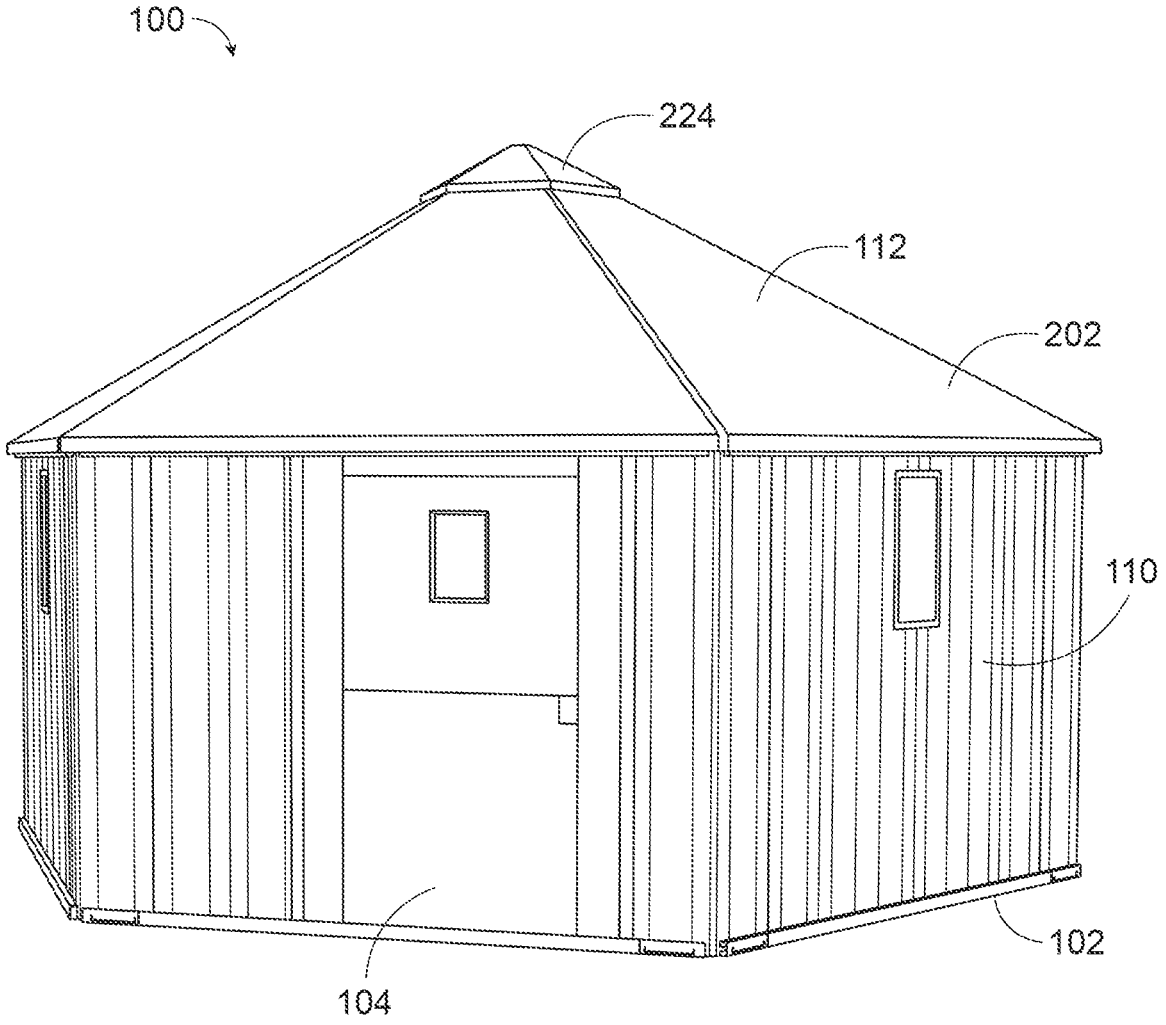
FIG. 1 is a perspective view of a structure.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 depicts a structure 100 including a frame 102, a door assembly 104, walls 110, and a roof 112 assembled to define an interior of the structure 100 and an exterior of the structure 100. In an embodiment, the structure 100 is a shelter configured for occupation by at least one user in the interior of the structure 100, however, the structure 100 may be otherwise configured for storage without departing from the scope of the present disclosure.

Figure 2:
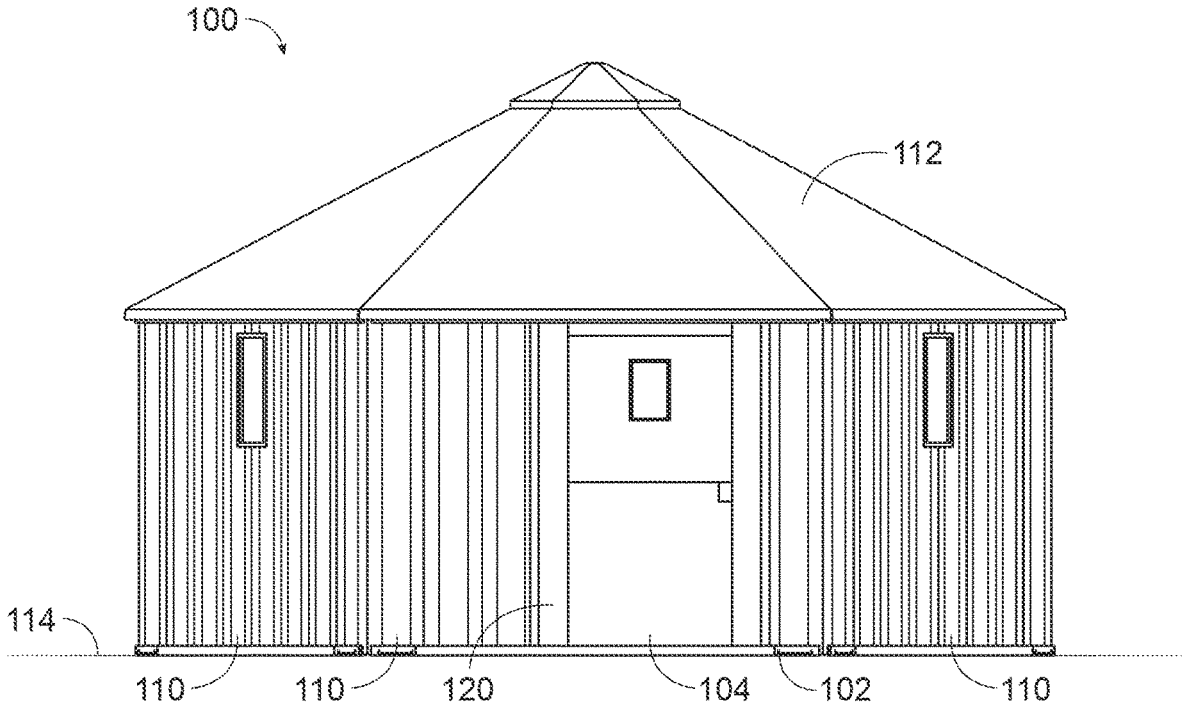
FIG. 2 is a front view of the structure.
Figure 3:
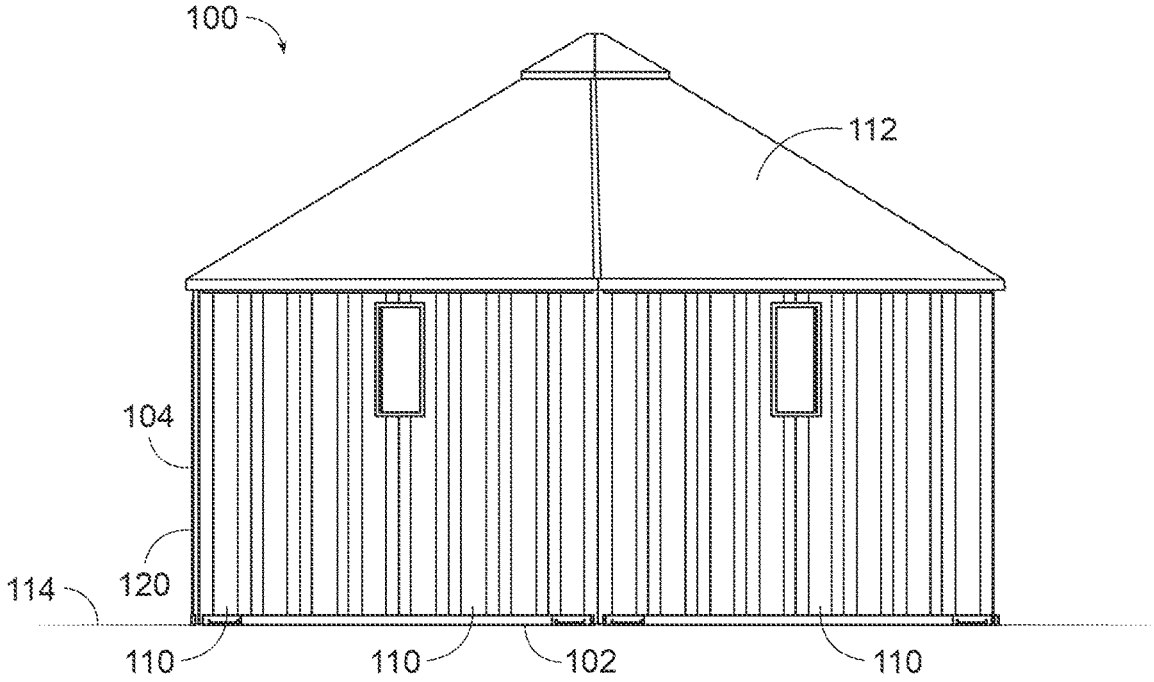
FIG. 3 is a side view of the structure.

FIG. 2 depicts a front view of the structure 100 in an upright position on a supporting surface 114 that is substantially horizontal such that the walls 110 and door runners 120 of the frame 102 are substantially vertical. FIG. 3 depicts a side view of the structure 100 in the upright position with respect to the supporting surface 114. As shown between FIGS. 2 and 3, the door assembly 104 and the walls 110 are disposed along the frame 102 to define the interior of the structure 100 in the radial direction of the structure 100.

Figure 5:
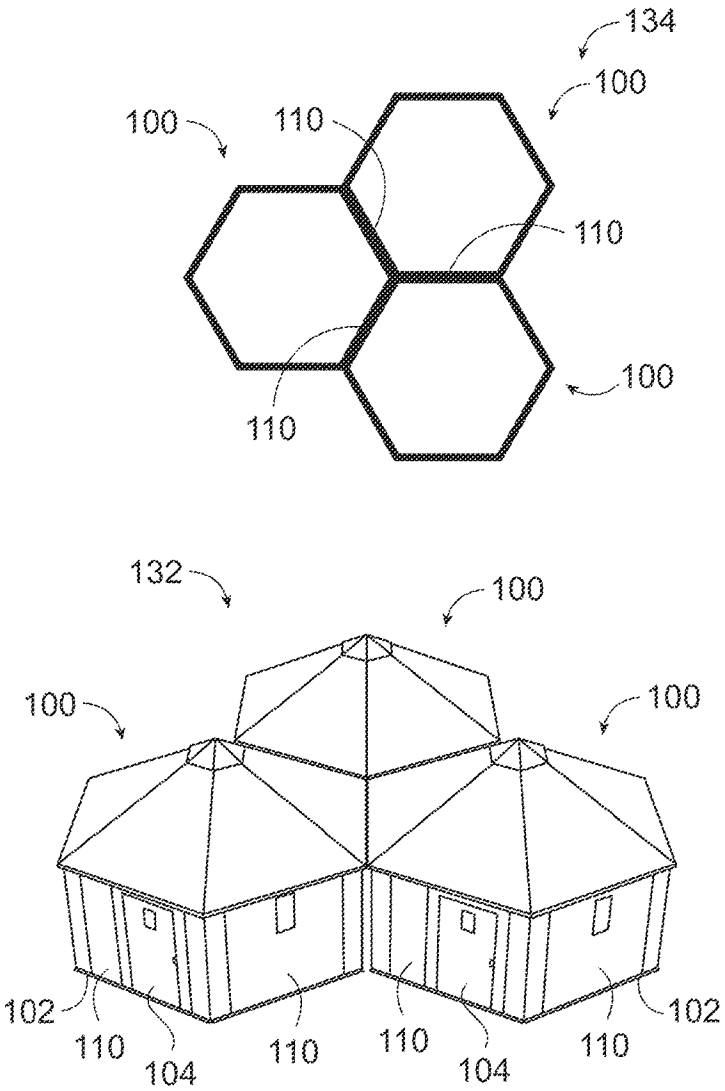
FIG. 5 is a perspective view of three structures arranged together with a corresponding floor plan.
Figure 4:
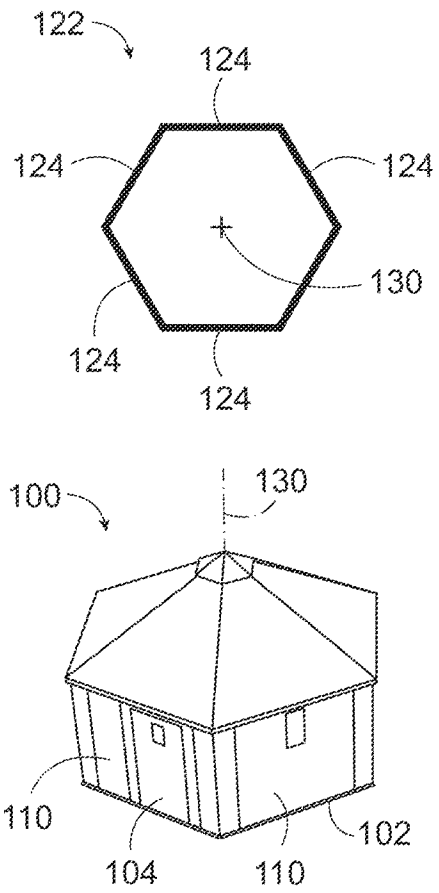
FIG. 4 is another perspective view of the structure with a corresponding floor plan.
Figure 6:
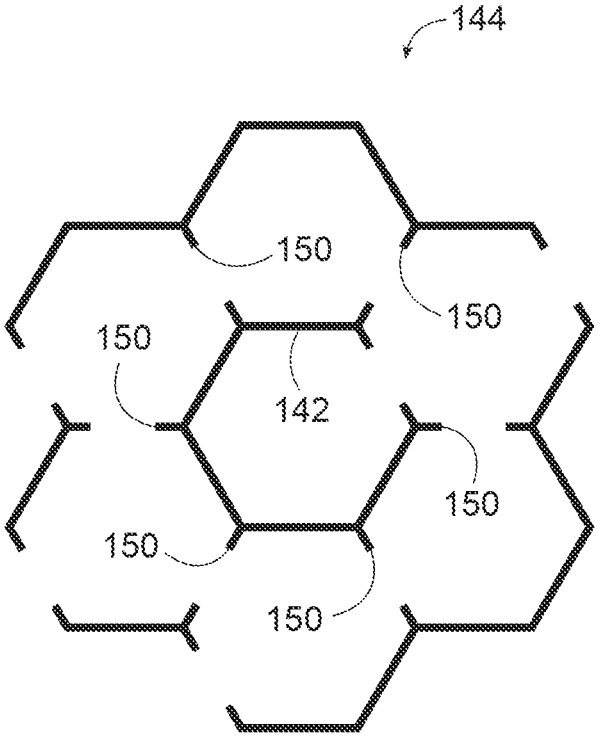
FIG. 6 is a perspective view of six structures arranged together with a corresponding floor plan.
Figure 6:
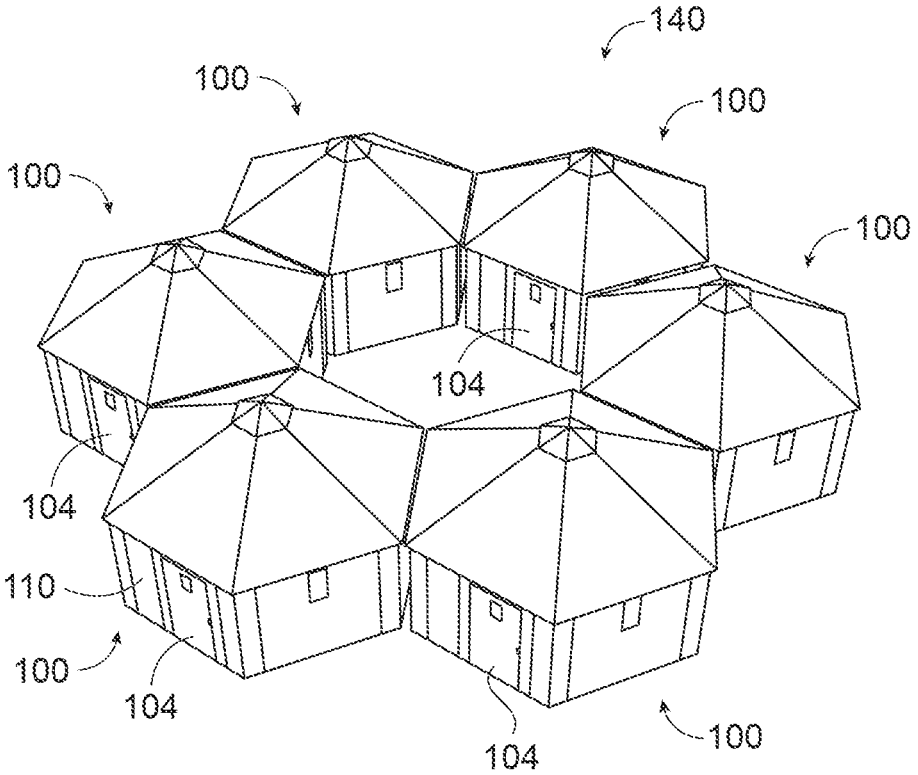

FIGS. 4-6 depict the structure 100 organized in various modular layouts. To this end, FIG. 4 depicts the structure 100 as a singular module. As shown in a corresponding floor plan 122, the frame 102, the door assembly 104, and the walls 110 form the structure 100 with six sides 124. The frame 102 is shaped as a regular hexagon with respect to a radial direction of the structure 100, and defines a geometric center of the structure 100 with respect to the radial direction of the structure 100 as denoted by a central axis 130 drawn extending in a vertical direction of the structure 100.

FIG. 5 depicts a first plurality 132 of structures 100 positioned and oriented adjacent to each other. Notably, the hexagonal shape of the structure 100 defined by the frame 102, the door assembly 104, and the walls 110 can be arranged in a tessellating pattern. As shown in a corresponding floor plan 134, the structures 100 in the first plurality 132 of structures 100 are arranged in a tessellating pattern such that each structure 100 borders the other two structures 100 in the first plurality 132 of structures 100. In an embodiment, walls 110 between structures 100 are partially formed so as to define openings between structures 100 through which users may pass. While the depicted structures 100 include a door assembly 104 respectively configured for opening to the exterior of the structure, at least one structure 100 in the plurality of structures may be constructed without a door assembly 104 that opens to the exterior of the structure 100, and instead the structure 100 without a door assembly 104 opens to adjacent structures 100 in the first plurality 132 of structures 100.

FIG. 6 depicts a second plurality 140 structures 100 including six structures 100 disposed in a hexagonal pattern so as to enclose a central area 142 defined within the second plurality 140 of structure 100. As shown in a corresponding floor plan 144, partially constructed walls 110 between consecutive structures 100 define wall openings 150 configured to enable a user to travel between consecutive structures 100 without exiting the second plurality 140 of structures 100. A structure 100 in the second plurality 140 of structures 100 includes a door assembly 104 configured to open to the central area 142 such that a user may access the central area 142 from the second plurality 140 of structures 100. While only one structure 100 is depicted as having a door assembly 104 that opens to the central area 142, more or fewer structures 100 in the second plurality 140 can have door assemblies which open to the central area 142 without departing from the scope of the present disclosure. Also, while the disclosed structure 100 embodies a regular hexagonal shape capable of arrangement in a tessellating pattern, the structure 100 may otherwise embody a repeatable shape, such as a rectangle, without departing from the scope of the present disclosure.

Figure 7:
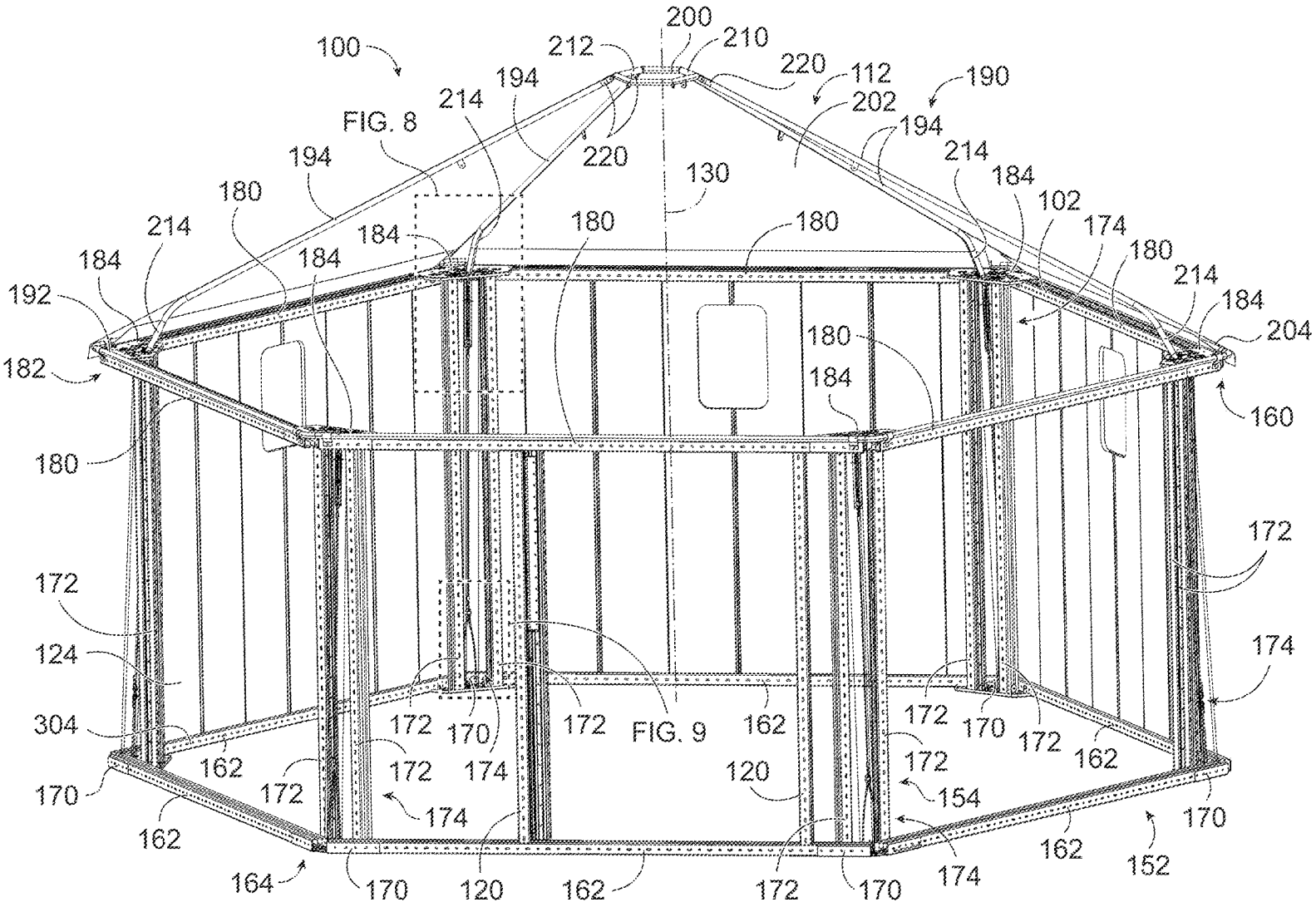
FIG. 7 is a partially constructed perspective view of the structure.

FIG. 7 depicts a partially constructed view of the structure 100 showing the frame 102 assembled in the upright position, supporting the roof 112. As shown, the frame 102 includes a footer 152, intermediate support 154, and a header 160. The footer 152 includes a plurality of footer beams 162 which are perimeter beams that respectively delineate a corresponding side 124 defining an outer perimeter of the structure 100 at a bottom 164 of the structure 100. The footer 152 also includes a plurality of footer corner brackets 170 that are corner brackets connecting consecutively arranged footer beams 162 such that the footer corner brackets 170 are respectively interposed between and separate consecutively arranged footer beams 162. In this manner, the footer 152 forms the outer perimeter of the structure 100 at the bottom 164 of the structure 100.

The intermediate support 154 is disposed between the footer 152 and the header 160 and is configured for supporting the header 160 above the footer 152. The intermediate support 154 includes the door runners 120, which respectively extend between the footer 152 and the header 160, from a footer beam 162 in a longitudinal direction of the structure 100 parallel with the central axis 130. The door runners 120 are configured for receiving the door assembly 104 in the longitudinal direction of structure 100 such that the door assembly 104 is supported in the frame 102 on the footer beam 162, between the door runners 120 along the outer perimeter of the structure 100.

The intermediate support 154 includes intermediate beams 172 disposed on and fixed with the footer corner brackets 170, the intermediate beams 172 extending from the footer 152 toward the header 160 in the longitudinal direction of the structure 100. As shown, pairs 174 of intermediate beams 172 are respectively disposed in each footer corner bracket 170, however more or fewer intermediate beams 172 can be respectively disposed on a corresponding footer corner bracket 170 without departing from the scope of the present disclosure.

The header 160 is supported in the structure 100 on top of the intermediate support 154. To this end, the header 160 includes a plurality of header beams 180 which are perimeter beams that respectively delineate a corresponding side 124 of the structure 100 at a top 182 of the frame 102. In this manner, the header beams 180 defining an outer perimeter at the top of the frame 102. The header 160 also includes a plurality of header corner brackets 184 that are corner brackets connecting consecutively arranged header beams 180 such that the header corner brackets 184 are respectively interposed between and separate consecutively arranged footer beams 162. The header corner brackets 184 connect consecutively arranged header beams 180 with a 120 degree angular offset such that the outer perimeter of the structure 100 at the top 182 of the frame 102 is shaped as a regular hexagon, and the footer corner brackets 170 connect consecutively arranged footer beams 162 with a 120 degree angular offset such that the outer perimeter of the structure 100 at the bottom 164 of the structure 100 is shaped as a regular hexagon.

Unless otherwise stated, the header beams 180 and header corner brackets 184 respectively function in a similar manner and have similar features as the footer beams 162 and the footer corner brackets 170. The footer corner brackets 170 and the header corner brackets 184 embody a single bracket design employed for each feature, with the footer corner brackets 170 assembled in the structure 100 having an orientation opposite to the header corner brackets 184 in a longitudinal direction of the structure 100. In this manner, the header corner brackets 184 and the footer corner brackets 170 are interchangeable in assembling the frame 102.

The footer beams 162, the door runners 120, the intermediate beams 172, and the header beams 180 embody a single beam design to have similar cross-sections respectively taken along a longitudinal direction of the footer beams 162, the door runners 120, the intermediate beams 172, and the header beams 180. Each of the footer beams 162, the door runners 120, the intermediate beams 172, and the header beams 180 can be roll formed steel, aluminum or other metal each cut to an appropriate length. The footer beams 162 and the header beams 180 have a same length and are interchangeable in assembling the frame 102.

With continued reference to FIG. 7, the roof 112 includes a tube assembly 190 having a tension bar 192, a plurality of arms 194, and a hub 200. The roof 112 also includes a cover 202 supported on the tube assembly 190 and configured to extend over the interior of the structure 100. The tension bar 192 is mounted on the header 160 at the header corner brackets 184, and the hub 200 is supported around the central axis 130. A cover 202 formed from fabric has an outer edge portion 204 wrapped around the tension bar 192 and an inner edge portion 210 wrapped around the hub 200. In this manner, the tension bar 192 is configured to maintain a tension in the cover 202 that is directed over the interior of the structure 100 between the tension bar 192 and the hub 200.

With the cover 202 wrapped around the hub 200, the roof 112 forms an aperture 212 in the cover 202 defined by the hub 200. While the depicted cover 202 is formed from fabric, and wrapped around the tension bar 192 and the hub 200, the cover 202 may alternatively be formed from similarly flexible materials and similarly fastened to the tension bar 192 and the hub 200, and further may alternatively be formed from a relatively inflexible material and otherwise fixed with respect to the tension bar 192 and the hub 200 without departing from the scope of the present disclosure.

The roof 112 includes the tube assembly 190 configured for supporting the cover 202 over the interior of the structure 100. The tube assembly 190 includes a plurality of arms 194 respectively corresponding with the header corner brackets 184, with an arm distal end portion 214 positioned on a corresponding header corner bracket 184 and overlapping the corresponding header corner bracket 184 in the longitudinal direction of the structure 100. Each arm 194 in the plurality of arms 194 respectively extends from the corresponding header corner bracket 184 toward the central axis 130, with an arm proximal end portion 220 fixed to the hub 200, the hub 200 being positioned around the central axis 130. Each arm 194 in the plurality of arms 194 is respectively inclined upwards along a radial direction of the structure 100 taken from the tension bar 192 toward the hub 200 such that a maximum height of the roof 112 is located closer to the hub 200 as compared to the frame 102, and such that a minimum height of the roof 112 is located closer to the frame 102 as compared to the hub 200. Between consecutive arms 194 in the plurality of arms 194, the cover 202 forms roof faces 222 respectively corresponding with each side 124 of the structure 100. As shown, the roof faces 222 are inclined with the arms 194 upwards along a direction taken from the tension bar 192 toward the hub 200.

As shown in FIG. 1, a cap 224 is positioned over the aperture 212 and is configured to close the aperture 212 from the exterior of the structure 100. In an embodiment, the aperture 212 and the cap 224 are collectively configured to function as a vent in fluid communication with ambient atmosphere from the exterior of the structure 100. The cap 224 and the cover 202 are configured for having a variety of colors, patterns, images, and logotypes visible from outside and additionally or alternatively inside the structure 100.

Figure 8:
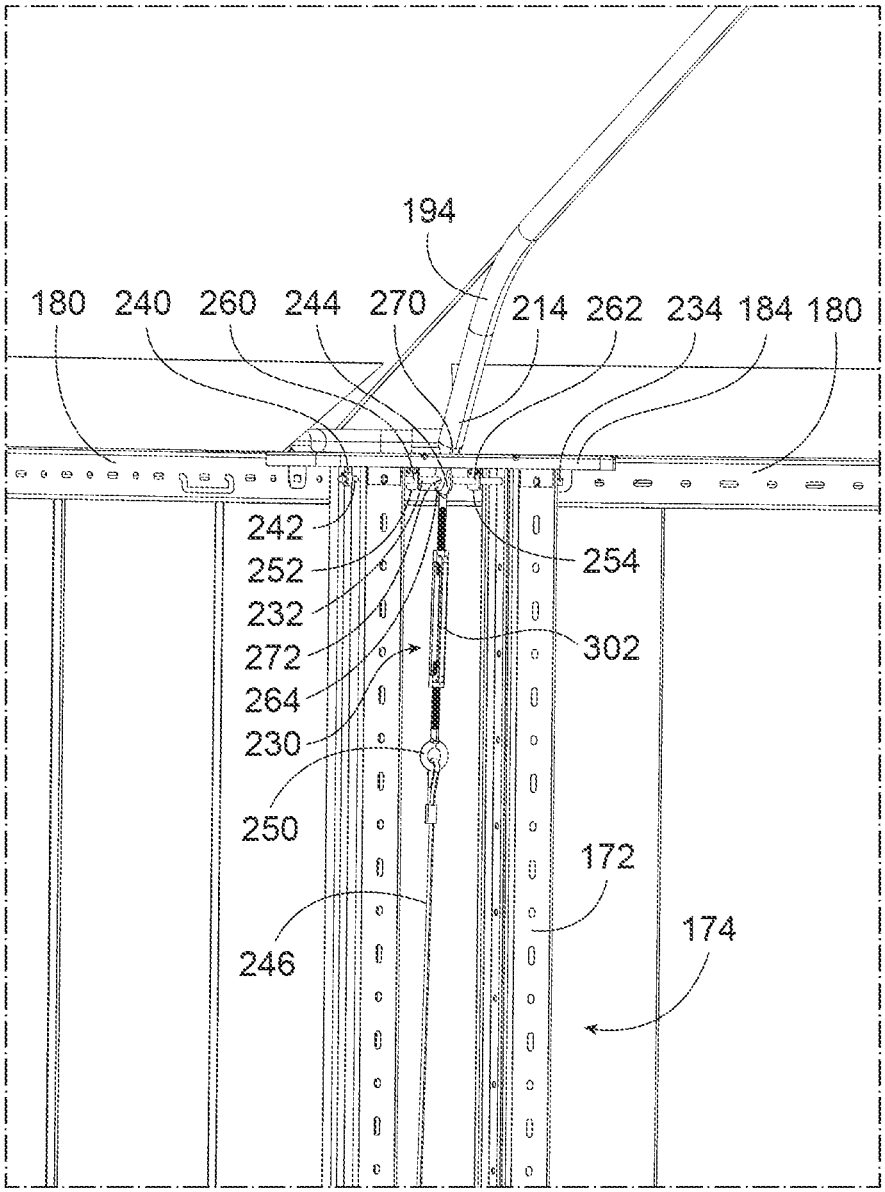
FIG. 8 is an enlarged partial view of the structure shown in FIG. 7.

With reference to FIG. 8, the arm distal end portion 214 can connect with an upper turnbuckle 230 at a roof fastener 232. The upper turnbuckle 230 is configured to exert tension along the intermediate beams 172 between the top 182 of the frame 102 and the bottom 164 of the structure 100.

The roof fastener 232 is a rod inserted through the pair 174 of intermediate beams 172 at a position closer to the top 182 of the frame 102 as compared to the bottom 164 of the structure 100. The roof fastener 232 is fixed with the pair 174 of intermediate beams 172 between a roof fastener end portion 234 extended from an end of the roof fastener 232 and a washer 240 fixed at an other end of the roof fastener 232 with a cotter pin 242. The roof fastener end portion 234 is fixed at the end of the roof fastener 232 and has a width that obstructs the roof fastener 232 from passing through the pair 174 of intermediate beams 172.

The upper turnbuckle 230 has an upper eyelet 244 disposed between the pair 174 of intermediate beams 172, along the roof fastener 232. The roof fastener 232 is inserted through the upper eyelet 244, fixing the upper turnbuckle 230 with the roof fastener 232. A lower eyelet 250 of the upper turnbuckle 230 receives an upper end of a cable 246 extended toward the bottom 164 of the structure 100 for fixing the upper turnbuckle 230 to the footer 152.

The roof fastener 232 is inserted through the header corner bracket 184, fixing the header corner bracket 184 with the pair 174 of intermediate beams 172 at the position closer to the top 182 of the frame 102 as compared to the bottom 164 of the structure 100. The header corner bracket 184 includes a first bracket flange 252 and a second bracket flange 254 positioned between the pair 174 of intermediate beams 172 along the roof fastener 232, on opposite sides of the upper eyelet 244. The first bracket flange 252 and the second bracket flange 254 extend downward, toward the bottom 164 of the structure 100 from the header 160. The roof fastener 232 is inserted through an opening 260 in the first bracket flange 252 and an opening 262 in the second bracket flange 254, fixing the header corner bracket 184 with the intermediate beams 172.

The roof fastener 232 is inserted through the arm distal end portion 214 positioned on the header corner bracket 184, fixing the arm 194 with the pair 174 of intermediate beams 172 at the position closer to the top 182 of the frame 102 as compared to the bottom 164 of the structure 100. The arm 194 positioned on the header corner bracket 184 includes an arm flange 264 extended from the arm distal end portion 214 through the header corner bracket 184 from the top 182 of the frame 102. The arm flange 264 is positioned with the upper eyelet 244 between the pair 174 of intermediate beams 172, and between the first bracket flange 252 and the second bracket flange 254 along the roof fastener 232. The roof fastener 232 is inserted through an opening 272 in the arm flange 264, fixing the arm 194 with the pair 174 of intermediate beams 172. With the upper turnbuckle 230, the header corner bracket 184, and the arm 194 fixed with the pair 174 of intermediate beams 172 at the position closer to the top 182 of the frame 102 as compared to the bottom 164 of the structure 100, the roof 112 and header 160 fixed in the frame 102 and tensioned to the footer 152 by the turnbuckle 230.

Figure 9:
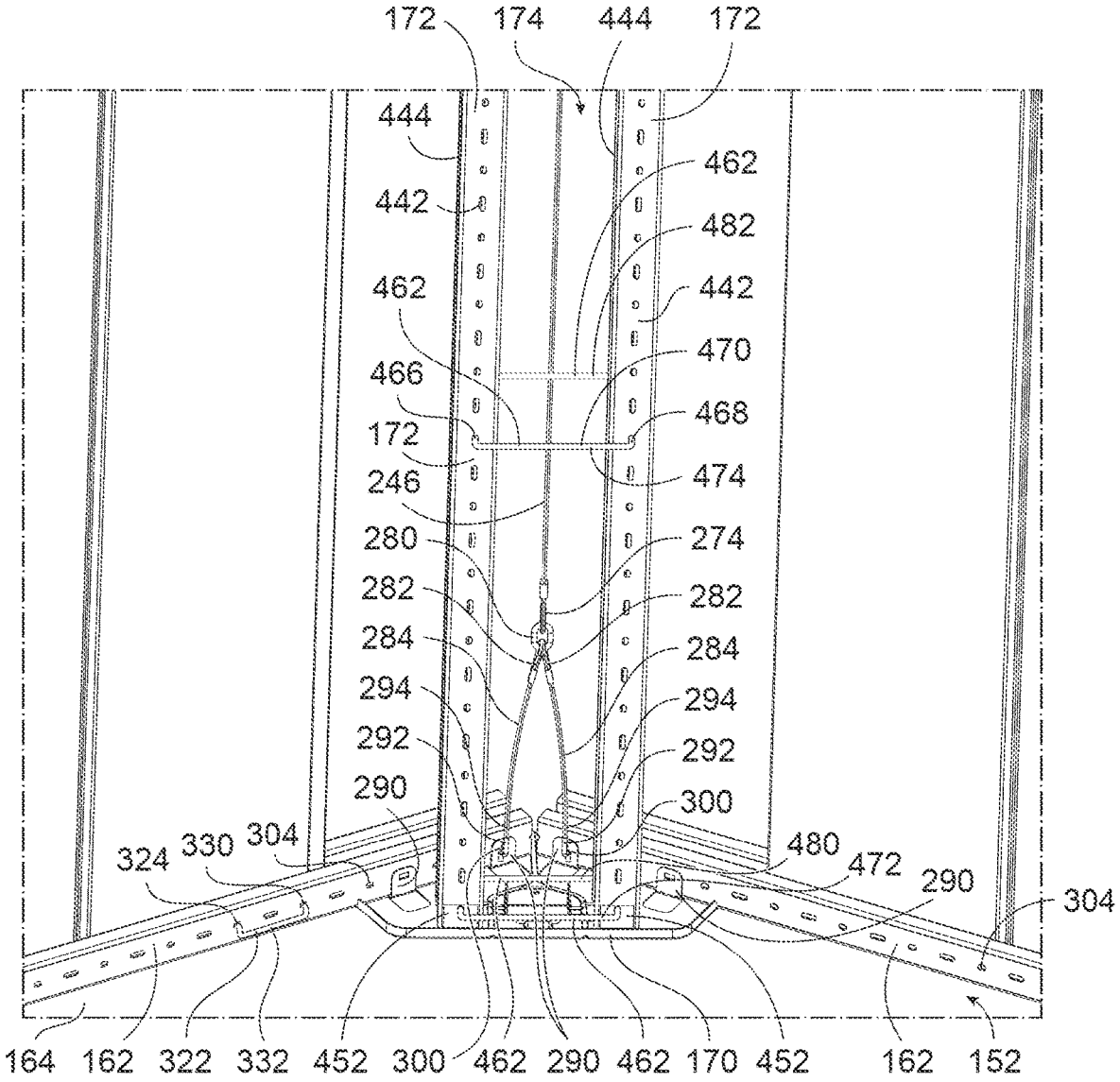
FIG. 9 is another enlarged partial view of the structure shown in FIG. 7.

With reference to FIG. 9, a looped lower end 274 of the cable 246 connects with a ring 280. The ring 280 receives looped upper ends 282 of two lower cables 284. Each footer corner bracket 170 includes a footer corner bracket inner wall 290 disposed on an inner side of each footer beam 162 inserted in the footer corner bracket 170. A hook 292 is provided at a lower end 294 of each lower cable 284 and fits into an opening 300 provided in each footer corner bracket inner wall 290 of each footer corner bracket 170. With reference back to FIG. 8, rotation of a turnbuckle body 302 tensions the cable 246, which holds down each arm 194 of the roof 112.

As shown in FIG. 9, the opening 300 in each footer corner bracket inner wall 290 is aligned with an opening 304 in one of the footer beams 162. Each hook 292 is respectively inserted through one of the openings 300 in the footer corner bracket inner walls 290 and the corresponding opening 304 in the corresponding footer beam 162, into the footer beam 162. In this manner, the upper turnbuckle 230 is fixed with the footer 152 at the footer corner bracket 170 and each of the footer beams 162 consecutively arranged at the footer corner bracket 170. Notably, in alternative embodiments each hook 292 may be respectively inserted through openings 310 in the intermediate beams 172 at the footer corner bracket 170 or otherwise at a position closer to the bottom 164 of the structure 100 as compared to the top 182 of the frame 102, fixing the upper turnbuckle 230 to the frame 102 at the footer corner bracket 170 and the intermediate beams 172.

Figure 10:
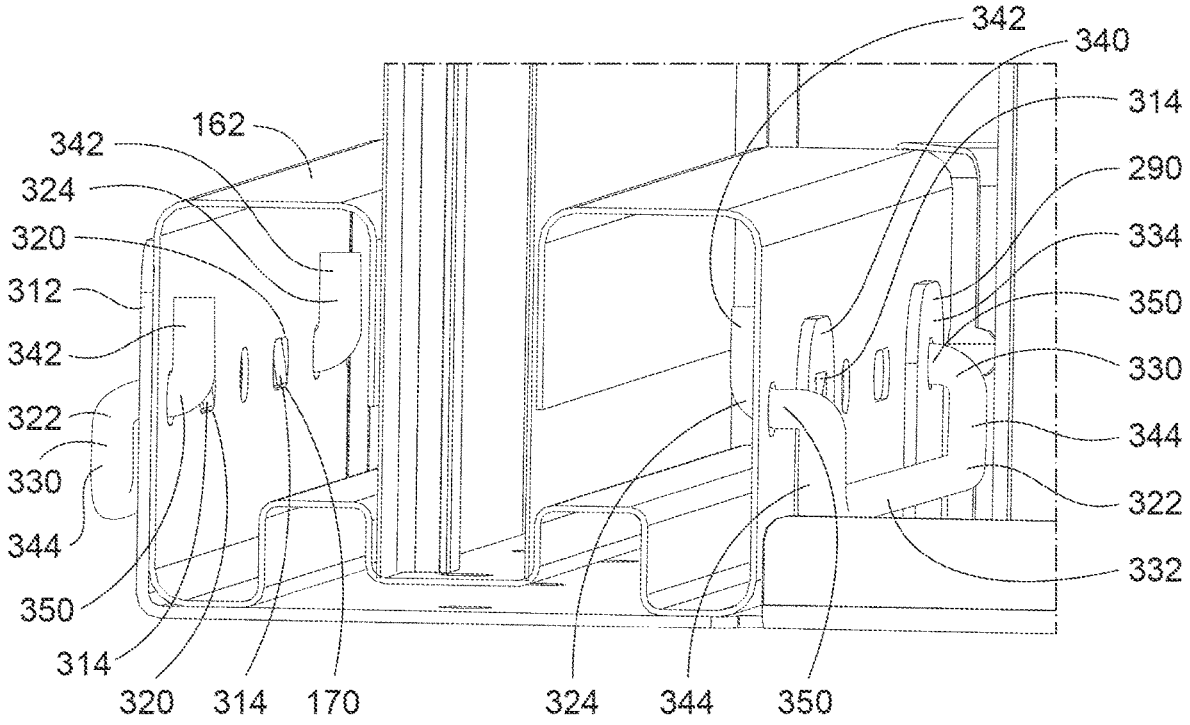
FIG. 10 is a partial perspective view of the structure including a footer beam fixed to a footer bracket with a perimeter beam fastener.

As shown in FIG. 10, each footer corner bracket 170 includes a footer corner bracket outer wall 312 disposed on an outer side of each footer beam 162 inserted the footer corner bracket 170. The footer corner bracket inner wall 290 and the footer corner bracket outer wall 312 are disposed on opposite sides of corresponding footer beams 162 for retaining the footer beams 162 in the frame 102. In this manner, footer beams 162 inserted in the footer corner bracket 170 are received between the footer corner bracket inner wall 290 and a footer corner bracket outer wall 312.

The footer corner bracket 170 includes protrusions 314 on the footer corner bracket inner wall 290 and the footer corner bracket outer wall 312, and the footer beams 162 inserted therein define catches 320 corresponding with the protrusions 314 on the footer corner bracket inner wall 290. The protrusions 314 on the footer corner bracket inner wall 290 and the footer corner bracket outer wall 312 are ramps inclined along an insertion direction of the footer beams 162 with respect to the footer corner bracket 170. The protrusions 314 on the footer corner bracket inner wall 290 are inclined from the footer corner bracket inner wall 290, toward the footer corner bracket outer wall 312. The protrusions 314 on the footer corner bracket outer wall 312 are inclined from the footer corner bracket outer wall 312, toward the footer corner bracket inner wall 290. The ramps forming the protrusions 314 end in steps configured to lock with the corresponding catches 320, fixing the footer corner bracket 170 with the footer beams 162 in a snap-fit assembly.

With this construction, when the footer beams 162 are inserted in the footer corner bracket 170 between the footer corner bracket inner wall 290 and the footer corner bracket outer wall 312, the protrusions 314 on the footer corner bracket inner wall 290 and the catches 320 defined in the footer beams 162 snap-fit together, locking the footer beams 162 with the footer corner brackets 170. In this manner, the footer beams 162 are configured for being toollessly snap-fit assembled with the footer corners brackets 170. While the depicted protrusions 314 are disposed on the footer bracket inner wall 290 and the footer bracket outer wall 312, and the depicted catches 320 are defined in the footer beams 162, the protrusions 314 may alternatively or additionally be located on the footer beams 162 with corresponding catches 320 defined in the footer corner bracket 170 without departing from the scope of the present disclosure.

With continued reference to FIG. 10, perimeter beam fasteners 322 are respectively fixed with the footer bracket inner wall 290 and the footer bracket outer wall 312, and fixed with the footer beam 162, fixing the footer corner bracket 170 to the footer beam 162. The perimeter beam fastener 322 has a first end portion 324 inserted through the footer corner bracket inner wall 290, into the corresponding footer beam 162, a second end portion 330 inserted into the footer 162 beam, and a body 332 that extends along the footer beam 162 from the first end portion 324 to the second end portion 330, fixing the footer corner bracket 170 to the footer beam 162.

The footer bracket inner wall 290 includes a first inner wall flange 334 and a second inner wall flange 340 arranged along the corresponding footer beam 162. The second inner wall flange 340 includes one of the protrusions 314 on the footer corner bracket 170. The corresponding footer beam 162 defines one of the catches 320 such that the footer beam 162 and the footer corner bracket 170 snap-fit together at the second inner wall flange 340 when the footer beam 162 is inserted between the footer corner bracket inner wall 290 and the footer corner bracket outer wall 312.

The first end portion 324 of the perimeter beam fastener 322 at the footer bracket inner wall 290 is inserted through the first inner wall flange 334, into the corresponding footer beam 162. The second end portion 330 of the perimeter beam fastener 322 is inserted into the corresponding footer beam 162 on a side of the second inner wall flange 340 opposite the first inner wall flange 334, with the body 332 extending along the corresponding footer beam 162, over the second inner wall flange 340 with respect to the footer beam 162.

Figure 11:
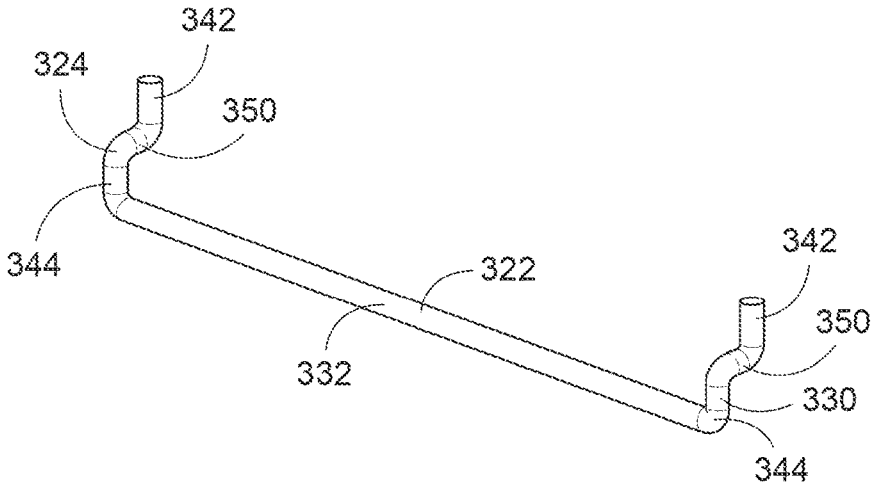
FIG. 11 is a perspective view of the perimeter beam fastener.

With reference to FIG. 11, the first end portion 324 and the second end portion 330 of the perimeter beam fastener 322 are formed with an S-bend having a first leg 342 extended from a middle portion 344, and a second leg 350 extended from a side of the middle portion 344 opposite the first leg 342 such that the middle portion 344 is interposed between and separates the first leg 342 and the second leg 350. The first leg 342 and the second leg 350 are bent in opposite directions from the middle portion 344. The body 332 extends straight from the second leg 350 of the second end portion 330 to the second leg 350 of the first end portion 324. As shown in FIG. 10, the first leg 342 of the first end portion 324 and the first leg 342 of the second end portion 330 are disposed in the footer beam 162, and the second leg 350 of the first end portion 324 and the second leg 350 of the second end portion 330 are disposed outside the footer beam 162. The middle portion 344 of each of the first end portion 324 and the second end portion 330 extends from inside the footer beam 162 at the first leg 342, to outside the footer beam 162 at the second leg 350.

Figure 12:
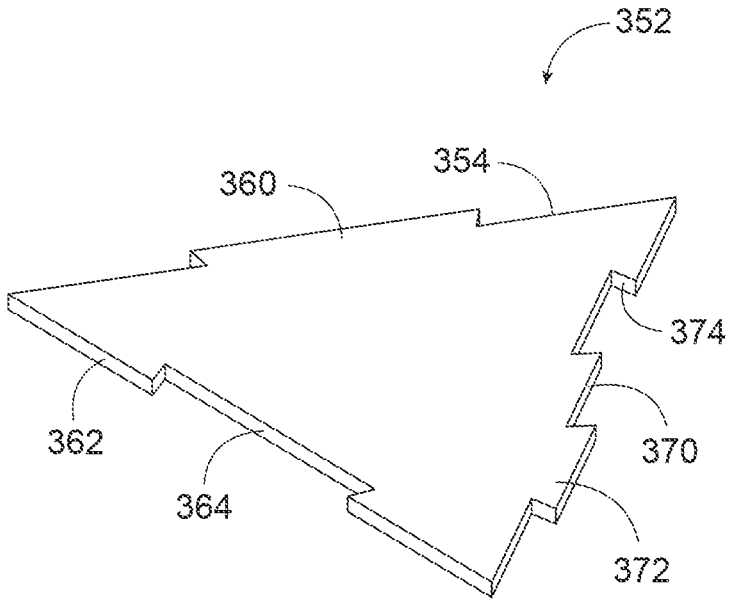
FIG. 12 is a perspective view of a floor tile for assembly in the structure.
Figure 13:
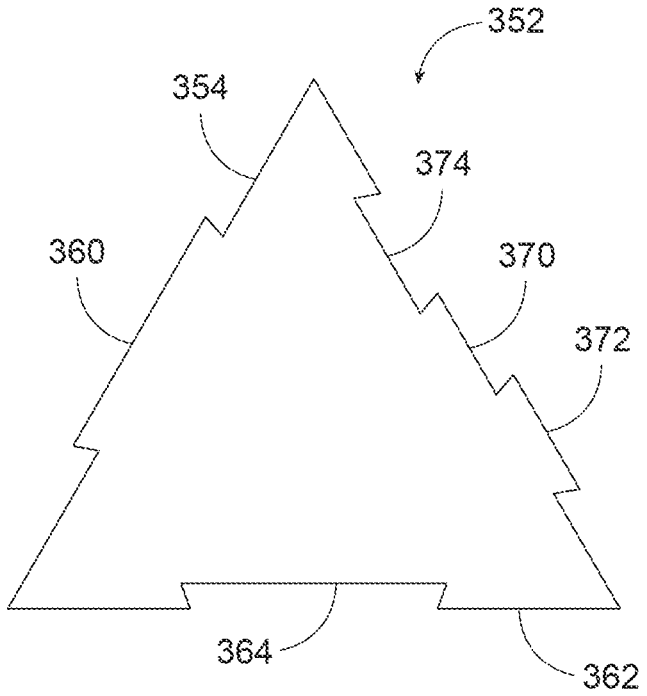
FIG. 13 is a plan view of the floor tile.

FIGS. 12 and 13 depict a floor tile 352 for use in the structure 100. The floor tile 352 can be made from molded plastic, die-cut recycled tire rubber and other appropriate durable material. In the illustrated embodiment, the floor tile 352 is generally triangular in plan view (see FIG. 13) and is shaped in the form of an equilateral triangle with sides interrupted by interlocking sections in the form of protuberances and recesses. A first side 354 of the floor tile 352 has a first side outward protuberance 360 in the shape of an isosceles trapezoid provided centrally between each end of the first side 354, with a first base on the first side 354, and a second base longer than the first base and offset outward from the first side 354 with respect to the floor tile 352. A second side 362 of the floor tile 352 defines a second side recess 364 in the shape of an isosceles trapezoid provided centrally between each end of the second side 362. The shape of the second side recess 364 matches the shape of the first side outward protuberance 360 so that the first side outward protuberance 360 can be received in the second side recess 364 to connect two similarly shaped floor tiles 352. A third side 370 of the floor tile 352 has a third side outward protuberance 372 in the shape of an isosceles trapezoid, albeit smaller than the first side outward protuberance 360, having a first base on the third side 370, and a second base longer than the first base and offset outward from the third side 370 with respect to the floor tile 352. The third side 370 defines a third side recess 374 in the shape of an isosceles trapezoid that matches the shape of the third side outward protuberance 372. To connect two similarly shaped floor tiles 352 along the third side 370 of each, a respective third side outward protuberance 372 of a first tile is received in the third side recess 374 of a second tile and the third side recess 374 of the first tile receives the third side outward protuberance 372 of the second tile. A plurality of floor tiles 352 can be connected with each other to form a floor 380 with a hexagonal floor pattern, which is shown in FIG. 14.

Figure 14:
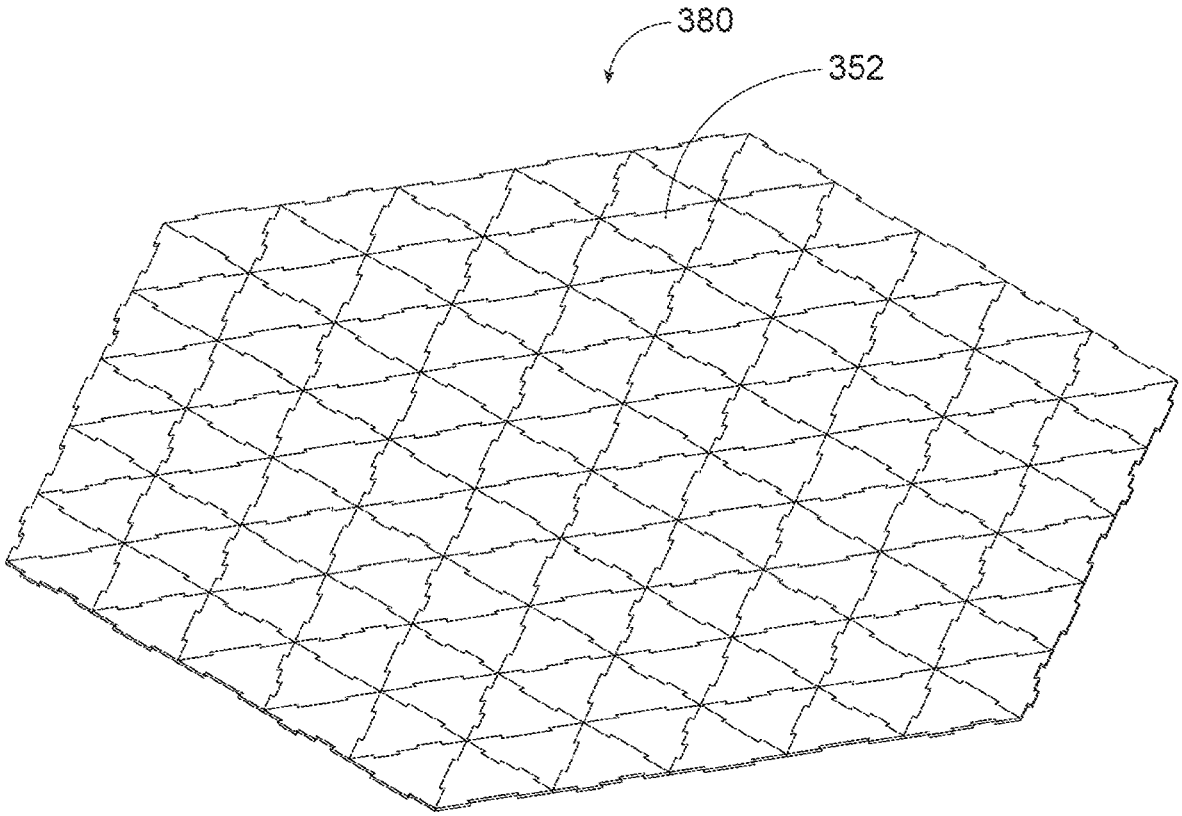
FIG. 14 is a perspective view of a floor pattern formed from a plurality of floor tiles.

As shown in FIG. 14, the plurality of floor tiles 352 are arranged in a tessellation that defines an outer perimeter having a shape similar to the hexagonal outer perimeter of the structure 100 defined by the footer beams 162. More specifically, the plurality of floor tiles 352 is a regular rotational tessellation of the plurality of floor tiles 352, the outer perimeter of the tessellation is shaped as a regular hexagon, and the outer perimeter of the structure 100 defined by the floor beams 162 is shaped as a regular hexagon. With this construction, the floor 380 is configured for being provided in the interior of the structure 100 at the bottom 164 of the structure 100 such that each side of the floor 380 extends along a respective footer beam 162 and the floor 380 fills an area defined by the footer beams 162 at the bottom 164 of the structure 100.

FIGS. 15-24 depict a method of assembling the structure 100. As depicted in FIG. 14, the footer corner brackets 170 are disposed on the supporting surface 114, and the footer beams 162 are inserted in the footer corner brackets 170. With reference back to FIG. 7, the central axis 130 can be located and a pin (not shown) can be inserted into an endmost opening among the openings 304 provided in each of the footer beams 162. A circle can be drawn using the pin to hold the footer beam 162, and the footer corner brackets 170 can be located along the circle that is drawn.

Figure 15:
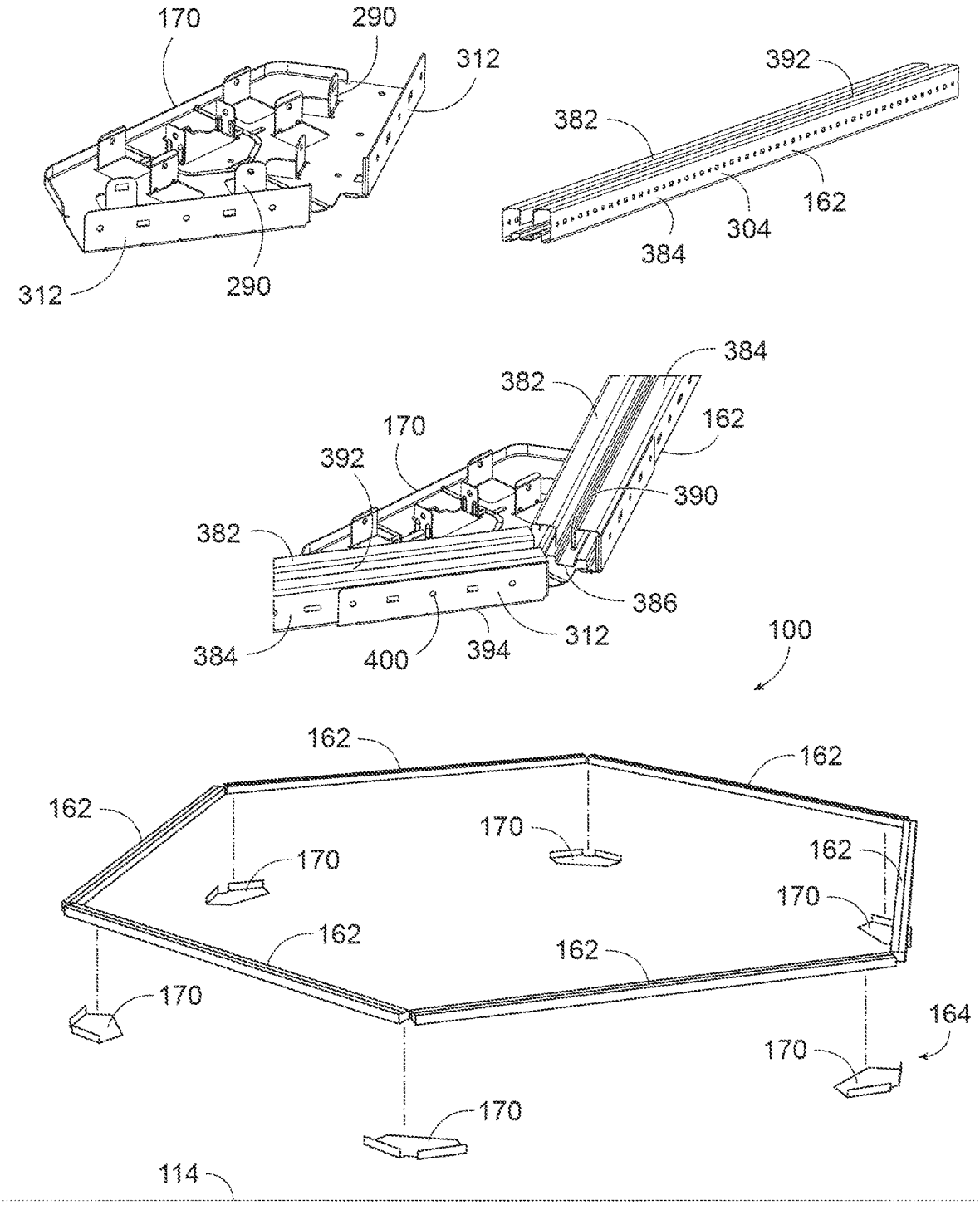
FIG. 15 is another partially constructed perspective view of the structure.

As shown in FIG. 15, the footer beams 162 are respectively inserted in each two consecutive footer corner brackets 170, defining the outer perimeter of the structure 100 at the bottom 164 of the structure 100. As shown, the footer corner bracket inner walls 290 and the footer corner bracket outer walls 312 are configured to abut the footer beams 162 inserted therein, thereby aligning the footer beams 162 along a hexagonal shape with respect to the supporting surface 114.

The footer beams 162 respectively include opposing footer beam inner walls 382 separated from respective opposing footer beam outer walls 384 in a lateral direction of the footer beam 162. The opposing footer beam inner walls 382 and footer beam outer walls 384, and a footer beam lower wall 386 having a plurality of openings 390 define a footer beam slot 392 along a longitudinal direction of the footer beam 162. When resting on the supporting surface 114 the footer beam lower wall 386 is vertically spaced above a lower end 394 of each footer corner bracket outer wall 312. Such a construction offsets the walls 110 from the supporting surface 114, which can get wet. The footer corner bracket outer walls 312 define openings 400 that align with the openings 304 in the footer beam outer walls 384 to receive perimeter beam fasteners 322 (see FIG. 7) to fasten each footer beam 162 to a respective footer corner bracket 170.

Figure 16:
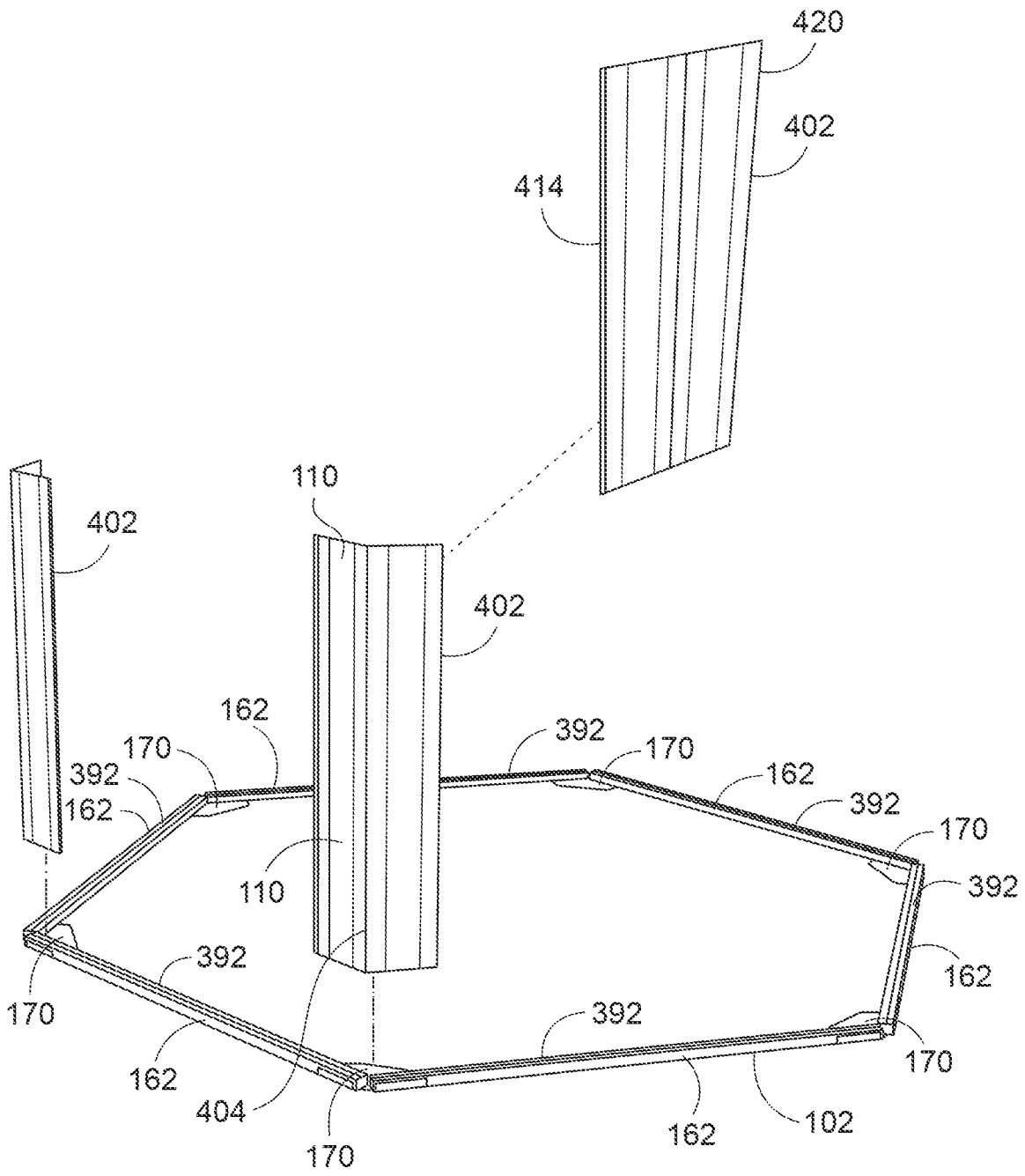
FIG. 16 is another partially constructed perspective view of the structure.

As depicted in FIG. 16, the walls 110 are formed from panels 402 of corrugated material which are configured for being bent along corners of the frame 102 shaped between consecutive footer beams 162 inserted in a same footer corner bracket 170. The panels 402 are inserted along the frame 102 in the footer beam slots 392. Each panel 402 can be a polyurethane sandwich panel having a weakened seam 404 where the panel 402 can be bent.

Figure 17:
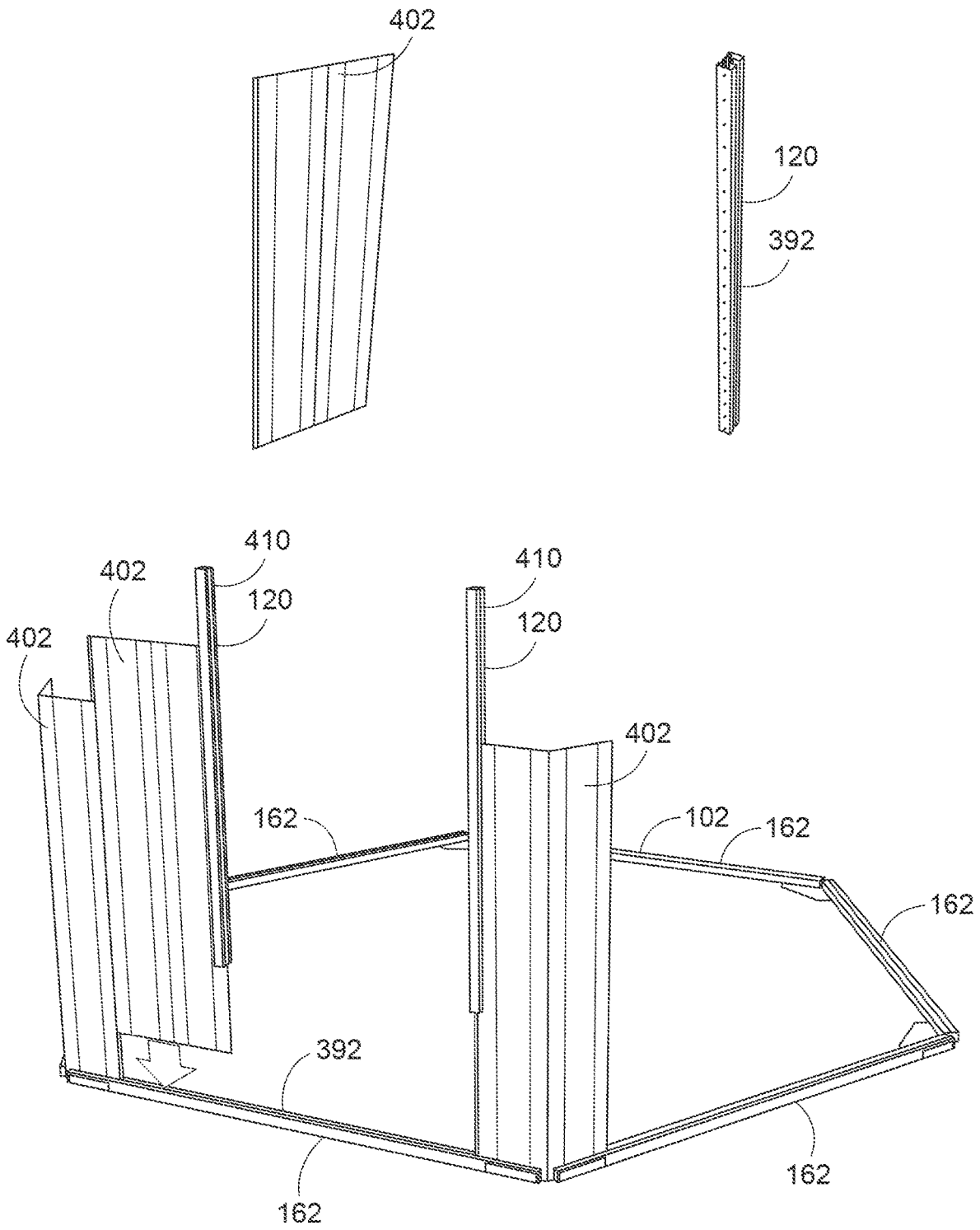
FIG. 17 is another partially constructed perspective view of the structure.

As depicted in FIG. 17, the door runners 120 are inserted into a footer beam slot 392 of a footer beam 162 along the panels 402. Similar to the footer beams 162, the door runners 120 respectively feature a door runner slot 410 along a longitudinal direction of the door runner 120. The door runner slots 410 are configured for receiving the door assembly 104 and supporting the door assembly 104 in the frame 102, and are configured for receiving the panels 402 and supporting the panels 402 in the frame 102.

Figure 18:
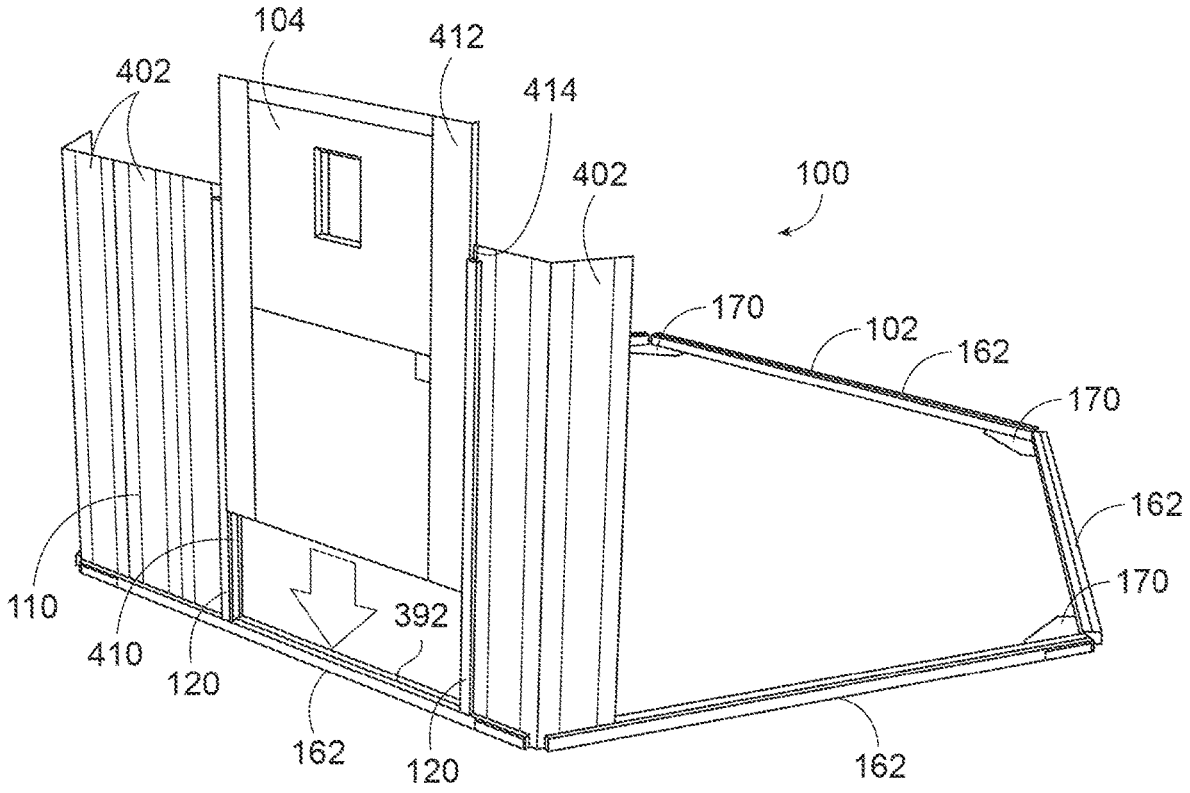
FIG. 18 is another partially constructed perspective view of the structure.

As depicted in FIG. 18, the door assembly 104 is inserted in the footer beam slot 392 between the door runners 120. The door assembly 104 includes a door frame 412 and a door 414, where the door frame 412 is inserted in the door runner slots 410 respectively defined in the door runners 120. The frame 102, the door assembly 104, and the panels 402 are cooperatively sized such that the door assembly 104 and one whole panel 402 fit together on a footer beam 162 to form a wall 110 between panels 402 inserted into footer corner brackets 170. In this manner, walls 110 of the structure 100 including the door assembly 104 can be assembled without modifying the frame 102, the door assembly 104, or the panels 402. While the structure 100 is depicted with one door assembly 104, more or fewer door assemblies 104 may be incorporated in the structure 100 without departing from the scope of the present disclosure.

Figure 19:
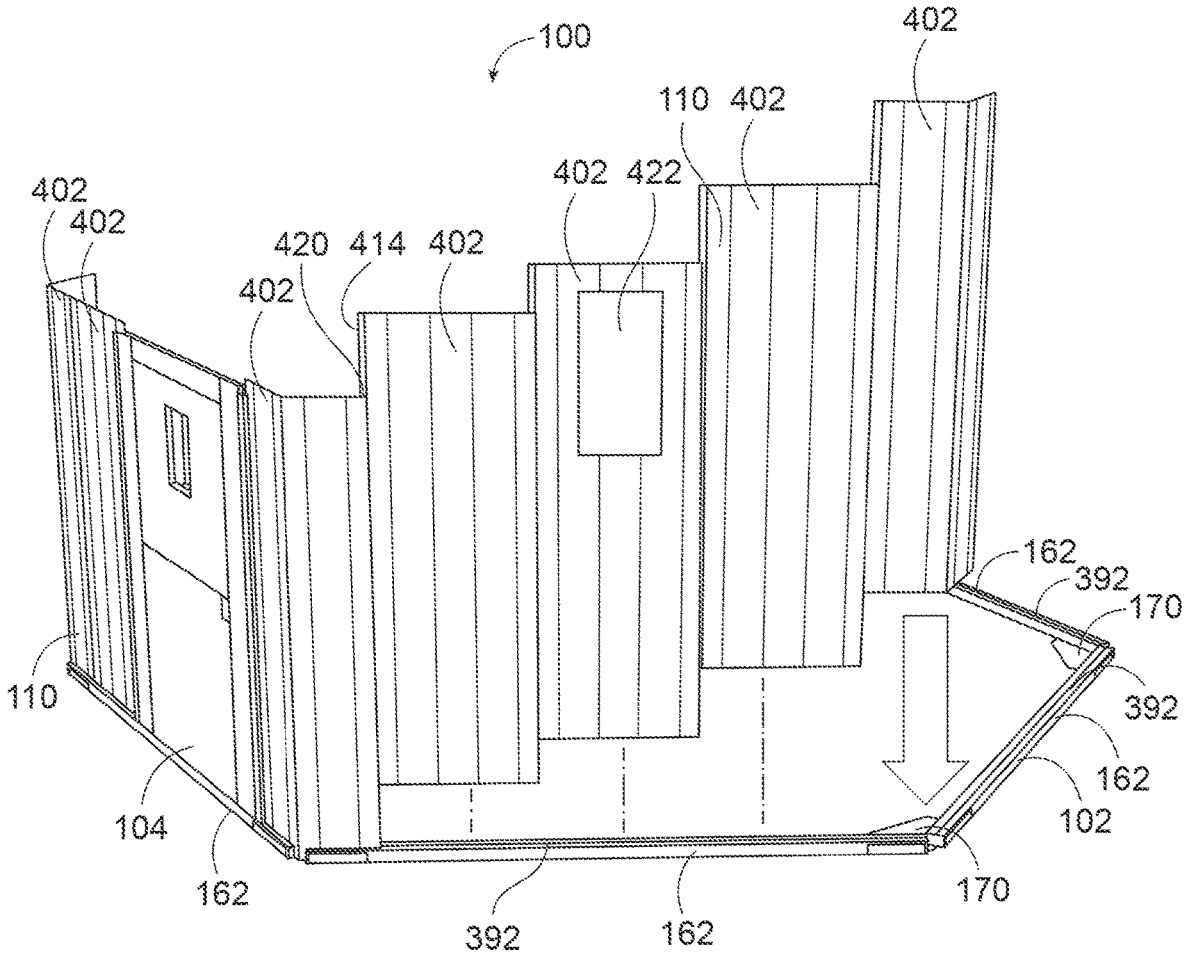
FIG. 19 is another partially constructed perspective view of the structure.

As depicted in FIG. 19, the panels 402 are inserted in the footer beam slots 392 along the frame 102. The frame 102 and the panels 402 are cooperatively sized such that three whole panels 402 fit together on a footer beam 162 to form a wall 110 between panels 402 inserted into footer corner brackets 170. In this manner, walls 110 of the structure 100 formed from the panels 402, with or without the door assembly 104, can be assembled without modifying the frame 102 or the panels 402. While the walls 110 are depicted as including three panels 402, the frame 102 and the panels 402 can be otherwise cooperatively sized to include a whole number of panels 402 without departing from the scope of the present disclosure. Each panel 402 includes a tongue 414 that fits into a groove 420 of another panel 402 to attach the panels 402 to one another.

As shown, a panel 402 includes a window 422. While the depicted walls 110 only feature one window 422 in each wall 110 that does not feature a door assembly 104, more or fewer panels 402 having windows 422 can be included in a wall 110 without departing from the scope of the present disclosure. Also, solar panels could be provided in addition to or in lieu of the window 422 to provide power for the structure 100. Water collection modules could also be provided in addition to or in lieu of the window 422 to provide water for inhabitants of the structure 100. Air conditioning and/or heating units could also be mounted in the openings provided for each window 422.

Figure 20:
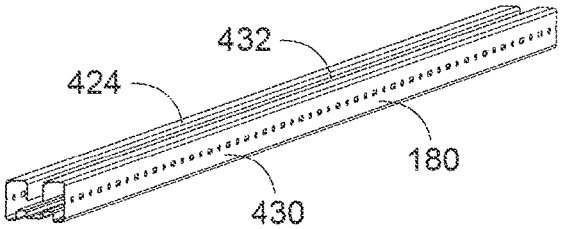
FIG. 20 is another partially constructed perspective view of the structure.
Figure 20:
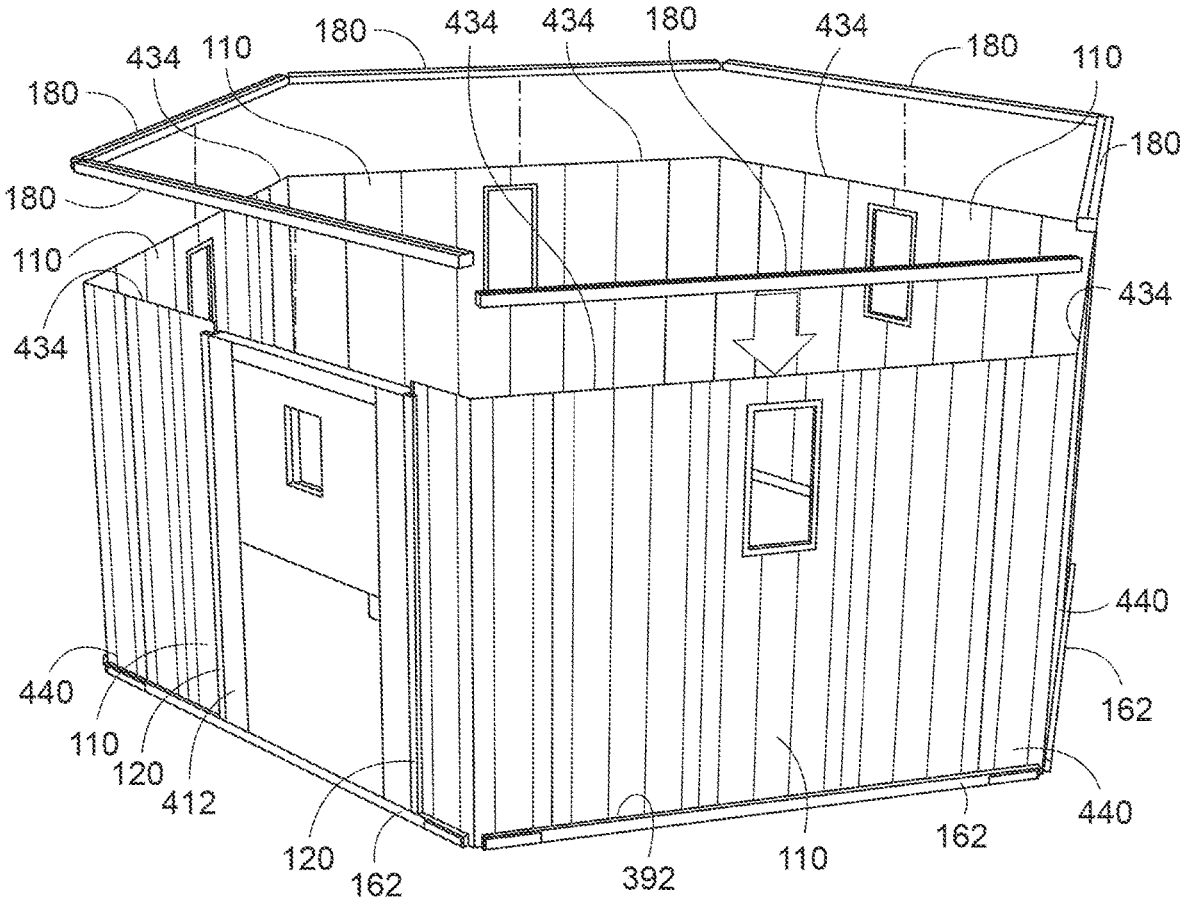

As depicted in FIG. 20, the header beams 180 are disposed on the walls 110. Similar to the footer beams 162 and the door runners 120, the header beams 180 respectively include opposing header beam inner walls 424 separated from respective opposing header beam outer walls 430 in a lateral direction of the header beam 180 to form a header beam slot 432 along a longitudinal direction of the header beam 180. Top ends 434 of the walls 110 formed from the door frame 412 and the panels 402 are inserted into the header beam slots 432 of corresponding header beams 180, and bottom ends 440 of the walls 110 are inserted into the footer beam slots 392 of corresponding footer beams 162. In this manner, the header beam slots 432 are configured for receiving the walls 110 and the footer beam slots 392 are configured for supporting the walls 110 received in the header beam slots 432.

Figure 21:
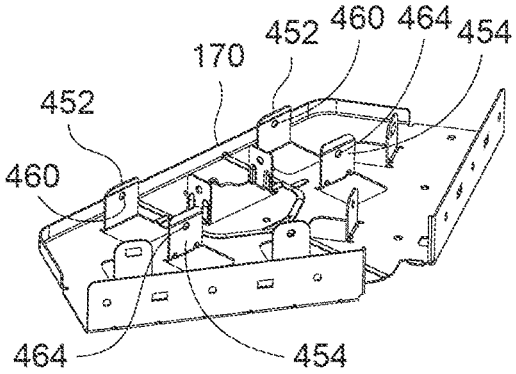
FIG. 21 is another partially constructed perspective view of the structure.
Figure 21:
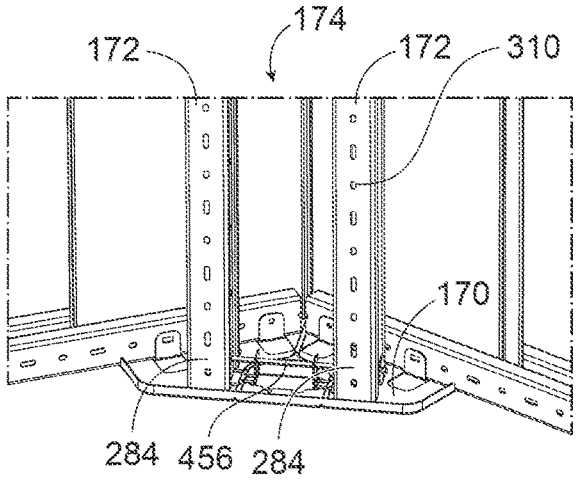
Figure 21:
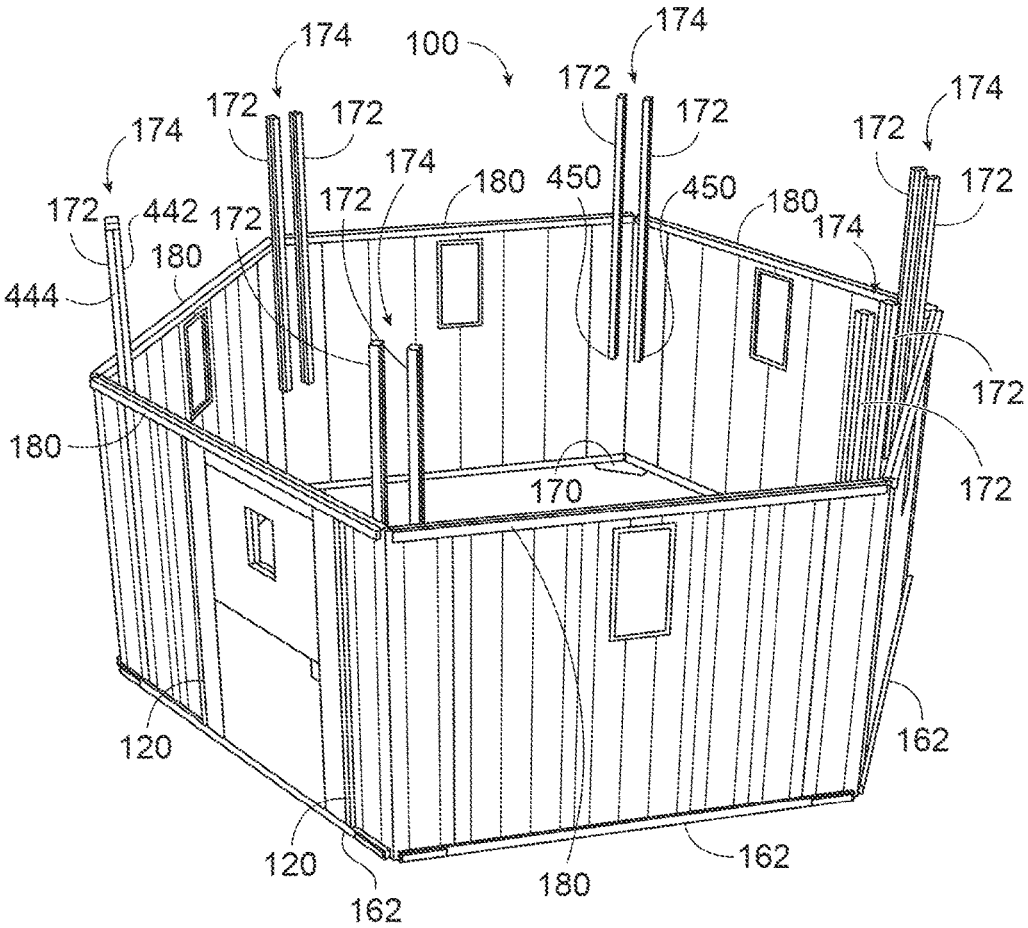

As depicted in FIG. 21, the pairs 174 of intermediate beams 172 are respectively received in and fixed with corresponding footer corner brackets 170. Similar to the footer beams 162, the door runners 120, and the header beams 180, the intermediate beams 172 respectively include opposing intermediate beam inner walls 442 separated from respective opposing intermediate beam outer walls 444 in a lateral direction of the intermediate beam 172. When the pairs 174 of the intermediate beams 172 are respectively assembled on the footer corner brackets 170, an intermediate beam bottom end 450 of the intermediate beam 172 is respectively disposed on a corresponding footer corner bracket 170.

When doing so, a footer corner bracket inner tab 452 is inserted into the intermediate beam bottom end 450 between the inner, with respect to the interior of the structure 100, intermediate beam inner wall 442 and intermediate beam outer wall 444, and a footer corner bracket outer tab 454 is inserted into the intermediate beam bottom end 450 between the outer, with respect to the interior of the structure 100, intermediate beam inner wall 442 and intermediate beam outer wall 444. When inserted in the corresponding intermediate beam bottom end 450, the footer corner bracket inner tab 452 is disposed against the intermediate beam inner wall 442 and the footer corner bracket outer tab 454 is disposed against the intermediate beam outer wall 444. In this manner, the footer corner bracket inner tab 452 and the footer corner bracket outer tab 454 are disposed against opposite sides of the corresponding intermediate beam bottom end 450.

A floor fastener 456 is inserted through the pair 174 of intermediate beams 172 and the footer corner bracket 170, fixing the pair 174 of intermediate beams 172 with the footer corner bracket 170. The floor fastener 456 and the roof fastener 232 embody a single fastener design such that the floor fastener 456 and the roof fastener 232 are interchangeable in assembly of the frame 102. As such, the floor fastener 456 includes similar features, and functions in a similar manner for fixing the pair 174 of intermediate beams 172 with the footer corner bracket 170 as the roof fastener 232 for fixing the pair 174 of intermediate beams 172 with the header corner bracket 184.

The footer corner bracket inner tab 452 is provided with an opening 460 that aligns with a respective opening 310 in the inner, with respect to the interior of the structure 100, intermediate beam outer wall 444, through which an intermediate beam fastener 462 (see FIG. 9) could be inserted. The footer corner bracket outer tab 454 is provided with an opening 464 that aligns with a respective opening 310 (see FIG. 7) in the outer, with respect to the interior of the structure 100, intermediate beam outer wall 444, through which the intermediate beam fastener 462 could be inserted.

As shown in FIG. 9, the frame 102 includes intermediate beam fasteners 462 fixed with each intermediate beam 172 in a pair 174 of intermediate beams 172, with some of the intermediate beam fasteners 462 additionally fixed with the footer corner bracket 170. The intermediate beams fasteners 462 each have a first end portion 466 and a second end portion 468 respectively inserted in the in the pair 174 of intermediate beams 172, with a body 470 extending between the pair 174 of intermediate beams 172 from the first end portion 466 to the second end portion 468.

A first intermediate beam fastener 472 and a second intermediate beam fastener 474 are inserted in the pair 174 of intermediate beams 172 at the intermediate beam inner wall 442. The first intermediate beam fastener 472 is also inserted through the footer corner bracket inner tab 452, fixing the corresponding intermediate beam 172 with the footer corner bracket 170. A third intermediate beam fastener 480 and a fourth intermediate beam fastener 482 are inserted in the pair 174 of intermediate beams 172 at the intermediate beam outer wall 444. The third intermediate beam fastener 480 is also inserted through the footer corner bracket outer tab 454 (see FIG. 21), fixing the corresponding intermediate beam 172 with the footer corner bracket 170.

The intermediate beam fastener 462 and the perimeter beam fastener 322 embody a single fastener design such that the intermediate beam fastener 462 and the perimeter beam fastener 322 are interchangeable in assembly of the frame 102. With this construction, the intermediate beam fasteners 462 are inserted in the intermediate beams 172 and the footer corner bracket 170 in a similar manner as the perimeter beam fasteners 322 are inserted in the footer beams 162 and the header beams 180, and inserted in the corresponding footer corner brackets 170 and header corner brackets 184.

In this manner, each intermediate beam 172 in the pairs 174 of intermediate beams 172 is fixed with respect to a corresponding footer corner bracket 170 at the footer corner bracket 170. Hooks, brackets and other items (not shown) can be received in the holes 310 in the inner, with respect to the interior of the structure 100, intermediate beam outer wall 444. Weights (e.g., sand bags and the like) can also be tethered to the intermediate beams 172 by way of these holes 310. While the depicted frame 102 includes four intermediate beam fasteners 462, with two of the intermediate beam fasteners 462 inserted in the footer corner bracket 170, the frame 102 may include more or fewer intermediate beam fasteners in various locations along the pairs 174 of intermediate beams 172 for fixing the pairs 174 of intermediate beams 172 to the footer corner bracket 170 without departing from the scope of the present disclosure.

Figure 22:
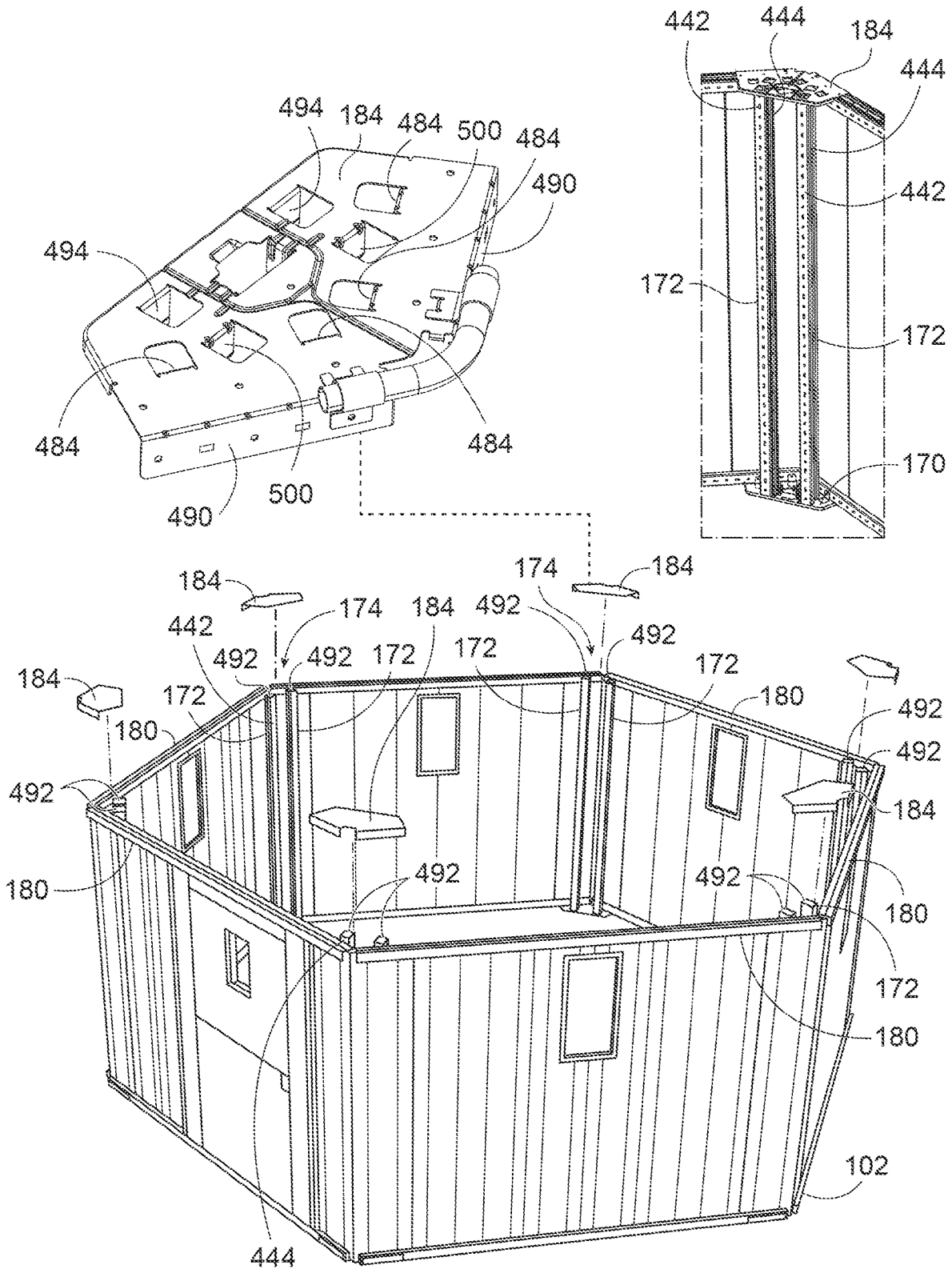
FIG. 22 is another partially constructed perspective view of the structure.

As depicted in FIG. 22, the header corner brackets 184 are disposed on the header beams 180 and the intermediate beams 172. The header corner brackets 184 can be stamped metal pieces that are identical in configuration to the footer corner brackets 170. More specifically, each of the header corner brackets 184 are respectively arranged on a corresponding corner of the frame 102 defined between consecutive header beams 180 with a header corner bracket inner wall 484 and a header corner bracket outer wall 490 disposed on opposing sides of each header beam 180 inserted in the header corner bracket 184, retaining the header beam 180 in the frame 102. With each header corner bracket 184 aligned on the frame 102, an intermediate beam top end 492 of each intermediate beam 172 in the pairs 174 of intermediate beams 172 is respectively connected with a corresponding header corner bracket 184 such that a header corner bracket inner tab 494 is inserted into the intermediate beam top end 492, and such that a header corner bracket outer tab 500 is inserted into the intermediate beam top end 492 in the same way that intermediate beams 172 connect with the corresponding footer corner brackets 170. As such, further description thereof is being omitted for the sake of brevity.

Figure 23:
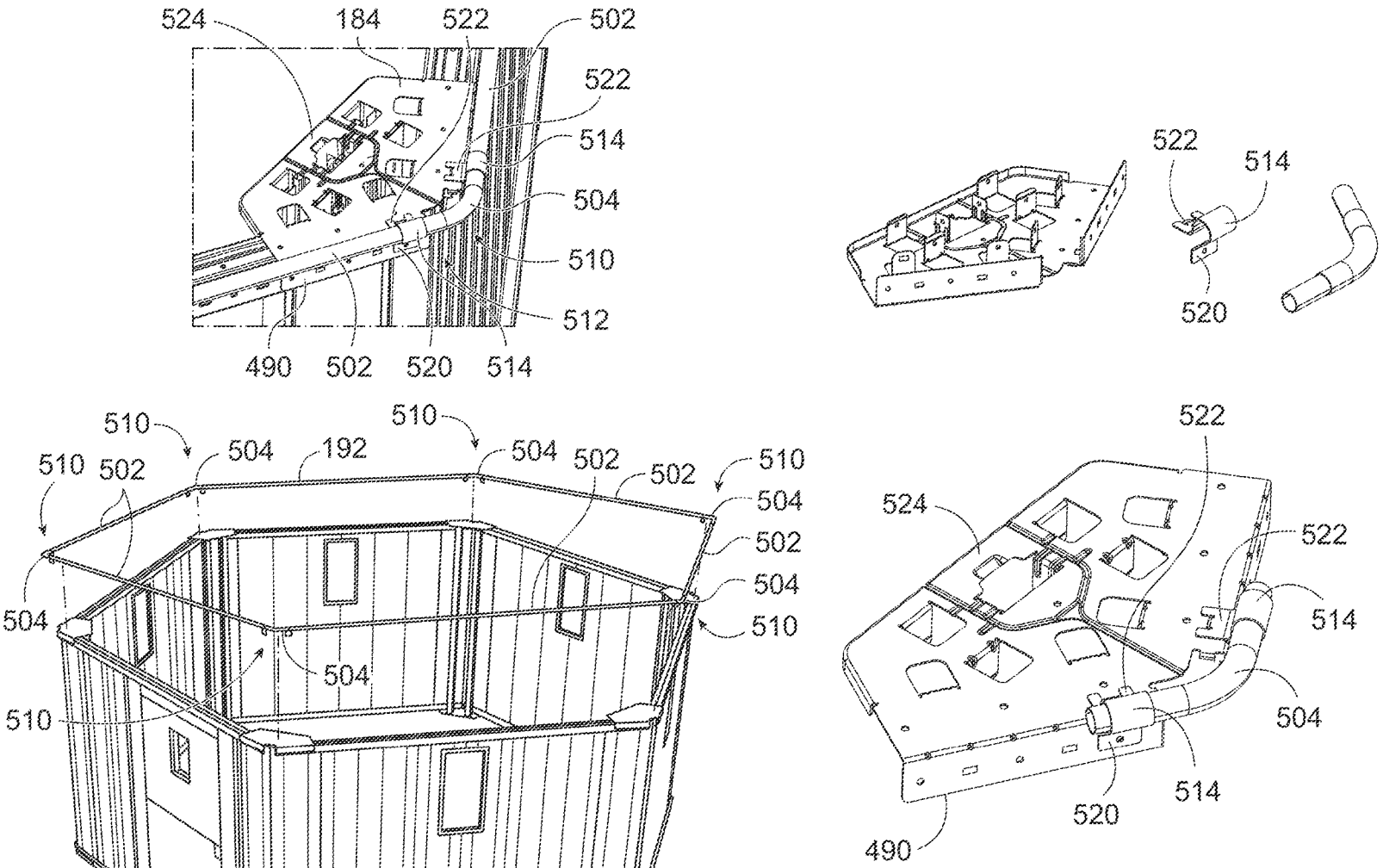
FIG. 23 is another partially constructed perspective view of the structure.

As depicted in FIG. 23, the tension bar 192 is assembled from a plurality of roof end tubes 502 and roof corner tubes 504 arranged in a hexagonal pattern, with consecutive roof end tubes 502 respectively interposed between and separated by a roof corner tube 504. The tension bar 192 provides hoop strength that helps keep the walls 110 tension bar from moving outward. A corner 510 of the tension bar 192 is defined at each roof corner tube 504 between consecutive roof end tubes 502, and a pair 512 of tension ring brackets 514 is fixed with respect to each corner 510 of the tension bar 192 such that each tension ring bracket 514 is respectively fitted around the corresponding roof corner tube 504. Each tension ring bracket 514 includes a first tension ring bracket flange 520 and a second tension ring bracket flange 522 disposed along and fixed with respect to a corresponding header corner bracket 184. As shown, the first tension ring bracket flange 520 extends along the header corner bracket outer wall 490 such that the first tension ring bracket flange 520 is configured for being fastened to the header corner bracket 184 at the header corner bracket outer wall 490. The second tension ring bracket flange 522 extends along a top surface 524 of the corresponding header corner bracket 184 such that the second tension ring bracket flange 522 is configured for being fastened to the header corner bracket 184 at the top surface 524 of the header corner bracket 184. The header corner bracket outer wall 490, the first tension ring bracket flange 520, the second tension ring bracket flange 522 and the roof corner tube 504 can be assembled and all fastened together prior to shipment.

Figure 24:
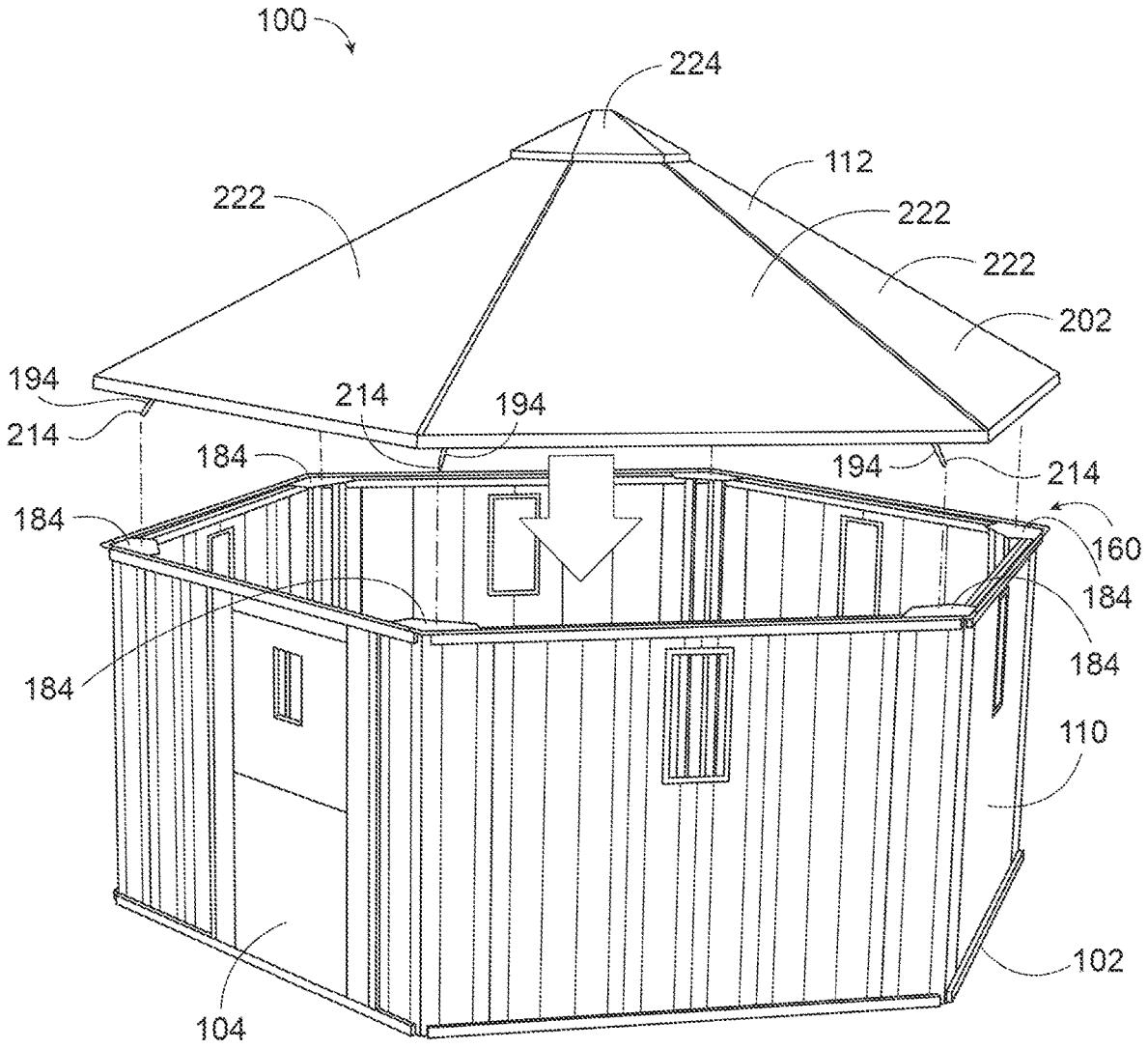
FIG. 24 is another partially constructed perspective view of the structure.

As depicted in FIG. 24, the roof 112 is assembled and attached to the header 160. More specifically, the arm distal end portion 214 of each arm 194 in the plurality of arms 194 is fixed with respect to a corresponding header corner bracket 184, where the plurality of arms 194 supports the hub 200, the cover 202, and the cap 224 over the interior of the structure 100.

It will be appreciated that variations of the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A modular structure comprising:

a frame including:

header beams defining an outer perimeter of the structure at a top of the frame, header corner brackets connecting consecutively arranged header beams, footer beams defining an outer perimeter of the structure at a bottom of the structure, footer corner brackets connecting consecutively arranged footer beams, and intermediate beams extended between the top of the frame and the bottom of the structure, each intermediate beam being fixed with one of the header corner brackets, and fixed with one of the footer corners brackets, a roof supported on the frame, the roof including an arm positioned on one of the header corner brackets, and a turnbuckle fixed with at least one of the header corner brackets, one of the header beams, one of the arm distal end portions, or one of the intermediate beams at a position closer to the top of the frame as compared to the bottom of the structure, and fixed with at least one of the footer corner brackets, one of the footer beams, or one of the intermediate beams at a position closer to the bottom of the structure as compared to the top of the frame, the turnbuckle being configured to exert tension along the intermediate beams between the top of the frame and the bottom of the structure, wherein one of the footer corner brackets includes a footer corner bracket inner wall disposed on an inner side of each consecutively arranged footer beam connected by the footer corner bracket, and the turnbuckle is fixed with the footer corner bracket through the footer corner bracket inner wall at each of the footer beams consecutively arranged at the footer corner bracket.

2. The structure of claim 1, wherein the intermediate beams include a pair of intermediate beams disposed on one of the footer corner brackets and fixed with one of the header corner brackets, and wherein the structure further comprises a roof fastener fixed with the turnbuckle and each intermediate beam in the pair of intermediate beams at a position closer to the top of the frame as compared to the bottom of the structure.

3. The structure of claim 2, wherein the roof fastener is a rod inserted through the pair of intermediate beams, and through an eyelet of the turnbuckle.

4. The structure of claim 3, wherein the roof fastener is inserted through the header corner bracket and the arm positioned on the header corner bracket.

5. The structure of claim 3, wherein the header corner bracket includes a bracket flange extended toward the bottom of the structure, and the roof fastener is inserted through the bracket flange.

6. The structure of claim 3, wherein the arm includes an arm flange extended through the header corner bracket from the top of the frame, and the roof fastener is inserted through the arm flange.

7. The structure of claim 2, wherein the roof fastener is fixed with the turnbuckle, each intermediate beam in the pair of intermediate beams, and the header corner bracket at the position closer to the top of the frame as compared to the bottom of the structure.

8. The structure of claim 2, wherein the roof fastener is fixed with the turnbuckle, each intermediate beam in the pair of intermediate beams, and the arm at the position closer to the top of the frame as compared to the bottom of the structure.

9. The structure of claim 1, wherein each of the header beams and the footer beams comprise a pair of parallel, elongated channel members, each channel member having a generally U-shaped cross-section with a series of spaced-apart openings along at least one side wall, the channel members being oriented in opposed relation to define a central slot configured to receive and retain an edge of a a respective wall panel, and wherein each end of each header beam is shaped to engage and lock into a corresponding header corner bracket among the header corner brackets and each end of each footer beam is shaped to engage and lock into a corresponding footer corner bracket among the footer corner brackets.

10. The structure of claim 1, wherein each of the header corner brackets and the footer corner brackets is formed from a stamped metal piece including multiple orthogonally projecting tabs having apertures positioned to receive fasteners that engage corresponding openings in the at least one of the header beams and the footer beams, each corner bracket being shaped to interlock with an end of at least one of the header beams and the footer beams and to maintain a fixed corner alignment for wall panels.

11. A frame for a modular structure, the frame comprising:

perimeter beams defining an outer perimeter of the structure;

corner brackets connecting consecutively arranged perimeter beams; and intermediate beams extended between a top of the frame and a bottom of the structure, each intermediate beam being fixed with at least one of the corner brackets, wherein the corner brackets each have a bracket inner wall and a bracket outer wall disposed on opposing sides of corresponding perimeter beams, and the frame further comprises a perimeter beam fastener with a first end portion inserted through the bracket inner wall, into the corresponding perimeter beam, a second end portion inserted into the perimeter beam, and a body that extends along the perimeter beam from the first end portion to the second end portion, fixing the corner bracket to the perimeter beam.

12. The frame of claim 11, wherein the bracket inner wall includes a first inner wall flange and a second inner wall flange arranged along the corresponding perimeter beam, the first end portion is inserted through the first inner wall flange, and the second end portion is inserted into the corresponding perimeter beam on a side of the second inner wall flange opposite the first inner wall flange, with the body extending along the corresponding perimeter beam, over the second inner wall flange with respect to the perimeter beam.

13. The frame of claim 12, wherein the second inner wall flange includes one of a protrusion and a catch, and the corresponding beam includes the other of the protrusion and the catch such that when the beam is inserted between the bracket inner wall and the bracket outer wall, the beam and the corner bracket snap-fit together.

14. The frame of claim 11, wherein the first end portion and the second end portion are formed with an S-bend having a first leg disposed in the corresponding perimeter beam, and a second leg oppositely disposed from the first end portion, outside the perimeter beam, and fixed with the body.

15. A modular structure comprising:

a frame including:

header beams defining an outer perimeter of the structure at a top of the frame, header corner brackets connecting consecutively arranged header beams, footer beams defining an outer perimeter of the structure at a bottom of the structure, footer corner brackets connecting consecutively arranged footer beams, and intermediate beams extended between the top of the frame and the bottom of the structure, each intermediate beam being fixed with one of the header corner brackets, and fixed with one of the footer corners brackets, a roof supported on the frame, the roof including an arm positioned on one of the header corner brackets, and a turnbuckle fixed with at least one of the header corner brackets, one of the header beams, one of the arm distal end portions, or one of the intermediate beams at a position closer to the top of the frame as compared to the bottom of the structure, and fixed with at least one of the footer corner brackets, one of the footer beams, or one of the intermediate beams at a position closer to the bottom of the structure as compared to the top of the frame, the turnbuckle being configured to exert tension along the intermediate beams between the top of the frame and the bottom of the structure, wherein one of the footer corner brackets includes a footer corner bracket inner wall and a footer corner bracket outer wall, one of the footer beams is received between the footer corner bracket outer wall and the footer corner bracket inner wall such that the footer corner bracket outer wall and the footer corner bracket inner wall are disposed on opposing sides of the footer beam, retaining the footer beam in the frame, and the turnbuckle includes a hook inserted through the footer corner bracket inner wall and into the footer beam received at the footer corner bracket inner wall, fixing the turnbuckle to the footer corner bracket and the footer beam received at the bracket inner wall.

16. A modular structure comprising:

a frame including:

header beams defining an outer perimeter of the structure at a top of the frame, header corner brackets connecting consecutively arranged header beams, footer beams defining an outer perimeter of the structure at a bottom of the structure, footer corner brackets connecting consecutively arranged footer beams, and intermediate beams extended between the top of the frame and the bottom of the structure, wherein the intermediate beams include a pair of intermediate beams fixed with and disposed on one of the footer corner brackets and fixed with one of the header corner brackets, a roof supported on the frame, the roof including an arm positioned on one of the header corner brackets, and a turnbuckle fixed with at least one of the header corner brackets, one of the header beams, one of the arm distal end portions, or one of the intermediate beams at a position closer to the top of the frame as compared to the bottom of the structure, and fixed with at least one of the footer corner brackets, one of the footer beams, or one of the intermediate beams at a position closer to the bottom of the structure as compared to the top of the frame, the turnbuckle being configured to exert tension along the intermediate beams between the top of the frame and the bottom of the structure, a roof fastener fixed with the turnbuckle and each intermediate beam in the pair of intermediate beams at a position closer to the top of the frame as compared to the bottom of the structure.

17. The structure of claim 16, wherein the roof fastener is a rod inserted through the pair of intermediate beams, and through an eyelet of the turnbuckle.

18. The structure of claim 17, wherein the roof fastener is inserted through the header corner bracket and the arm positioned on the header corner bracket.

19. The structure of claim 17, further comprising a plurality of wall panels extending between the footer beams and the header beams, each wall panel being a sandwich panel having a weakened seam where the wall panel can be bent.

* * * * *